US008926224B2

(12) United States Patent
Seng et al.

(10) Patent No.: US 8,926,224 B2
(45) **Date of Patent: *Jan. 6, 2015**

(54) MULTI-DIRECTION DIRECT CANTILEVER SKIDDING SYSTEM

(71) Applicants: Offshore Technology Development, Singapore (SG); Keppel Offshore & Marine Technology Center, Singapore (SG)

(72) Inventors: Foo Kok Seng, Singapore (SG); Matthew Quah Chin Kau, Singapore (SG); Michael John Perry, Singapore (SG); Xiao Yu Shan, Singapore (SG)

(73) Assignees: Offshore Technology Development, Singapore (SG); Keppel Offshore & Marine Technology Center, Singapore (SG)

( * ) Notice: Subject to any disclaimer, the term of this patent is extended or adjusted under 35 U.S.C. 154(b) by 39 days.

This patent is subject to a terminal disclaimer.

(21) Appl. No.: 13/835,020

(22) Filed: Mar. 15, 2013

(65) Prior Publication Data

US 2014/0270974 A1 Sep. 18, 2014

(51) Int. Cl.

| | |
|---|---|
| ***E02B 17/00*** | (2006.01) |
| ***E21B 15/00*** | (2006.01) |
| ***E02B 17/02*** | (2006.01) |

(52) U.S. Cl.

CPC ..... *E21B 15/003* (2013.01); *E02B 17/021* (2013.01)

USPC ..... 405/201

(58) Field of Classification Search

CPC ..... E02B 17/00; E02B 17/02; E02B 17/021; E02B 2017/00

USPC ..... 405/195.1, 201

See application file for complete search history.

(56) References Cited

U.S. PATENT DOCUMENTS

| | | | | | |
|---|---|---|---|---|---|
| 3,477,235 | A * | 11/1969 | Hester, Jr. et al. | ..... | 405/201 |
| 4,068,487 | A * | 1/1978 | Pease et al. | ..... | 405/201 |
| 4,081,932 | A * | 4/1978 | Armstrong | ..... | 405/201 |
| 5,407,302 | A * | 4/1995 | Springett et al. | ..... | 405/201 |
| 5,997,217 | A * | 12/1999 | Verret | ..... | 405/201 |
| 6,171,027 | B1 | 1/2001 | Blankestijin | | |
| 6,729,804 | B1 * | 5/2004 | Roodenburg et al. | ..... | 405/201 |
| 6,997,647 | B2 * | 2/2006 | Bennett et al. | ..... | 405/201 |
| 7,083,004 | B2 | 8/2006 | Roodenburg et al. | | |
| 7,410,326 | B2 * | 8/2008 | Morrison et al. | ..... | 405/201 |
| 8,287,212 | B2 * | 10/2012 | Roper | ..... | 405/201 |
| 8,439,606 | B2 * | 5/2013 | Foo et al. | ..... | 405/201 |
| 2004/0067110 | A1 * | 4/2004 | Bennett et al. | ..... | 405/201 |
| 2004/0151549 | A1 * | 8/2004 | Roodenburg et al. | ..... | 405/201 |
| 2010/0260555 | A1 * | 10/2010 | Foo et al. | ..... | 405/201 |

FOREIGN PATENT DOCUMENTS

| | | | | | |
|---|---|---|---|---|---|
| WO | WO 2004035985 | A1 * | 4/2004 | ..... | E21B 15/00 |
| WO | WO 2012036630 | A1 * | 3/2012 | ..... | E21B 19/00 |
| WO | WO 2013133694 | A1 * | 9/2013 | ..... | E02B 17/00 |

* cited by examiner

*Primary Examiner* — Frederick L Lagman

(74) *Attorney, Agent, or Firm* — Duane Morris LLP

(57) ABSTRACT

The present subject matter provides a multi-direction direct cantilever skidding system suitable for an offshore drilling system, where the multi-direction direct cantilever skidding system comprises movable guides accommodating a cantilever of a Jackup drilling unit or other mobile platform and enabling transverse skidding rails to provide direct support for the cantilever so the cantilever may be moved longitudinally and transversely.

24 Claims, 48 Drawing Sheets

MULTI-DIRECTION DIRECT CANTILEVER SKIDDING SYSTEM

CROSS REFERENCES

The present application is co-pending with and related to the non-provisional application entitled, "Multipurpose Cantilever Skidding Frame," application Ser. No. 13/834,816, filed on 15 Mar. 2013 and to the non-provisional application entitled, "Three Rail Multi-Direction Direct Cantilever Skidding System," application Ser. No. 13/835,214, filed on 15 Mar. 2013 the entirety of each being incorporated herein by reference.

BACKGROUND

The present subject matter relates generally to a drilling rig, and more particularly to a multipurpose cantilever skidding frame that can be employed in a drilling rig. The present subject matter also relates to a drilling rig having a multi-direction direct cantilever skidding system that can be employed in a Jackup drilling unit or other types of mobile platforms.

The wells to be drilled may be arranged in a grid, requiring the drilling derrick to be moved in both longitudinal and transverse directions to access the various locations of the wells. In a traditional cantilever arrangement, a Jackup drilling unit or other mobile platform may access wells through a combination of a longitudinal motion of the cantilever that skids in and out of the Jackup hull, and a transverse skidding of the drill floor at the end of the cantilever. This arrangement may be effective if the well pattern is contained within a small envelope; however, the extent to which the drill floor can skid in a transverse direction is limited. In addition, as the load is significantly offset from the cantilever center to access the side wells loads on the side of the cantilever in the direction of the offset will be increased, usually resulting in a reduced load capacity for extreme transverse drilling positions.

A cantilever skidding system allowing a cantilever to skid in both longitudinal and transverse directions is disclosed in U.S. Pat. No. 6,171,027. In this system, a drill floor is fixedly mounted to a cantilever to solve the offset problem caused by the movable Jackup drilling unit. The transverse reach of the drill floor is enabled by the transverse cantilever skidding. The cantilever is movably connected to the supporting members which are movably connected to transverse rails. The cantilever moves longitudinally over the supporting members, and the cantilever together with the supporting members move transversely over the transverse rails. The supporting members thus support the cantilever at all times and carry the full weight of the cantilever even when it is retracted. During installation, the supporting members must be accurately aligned, and then the heavy cantilever, must be lifted and slowly slid into the supporting members. Such an operation is both challenging and complex. Further, once installed the supporting members are always under load and are therefore not able to be easily accessed for inspection and maintenance

SUMMARY

The present subject matter provides a Jackup drilling unit with a drill floor supporting a drilling derrick extending beyond the Jackup hull by a cantilever to drill exploration or production wells. Additional embodiments provide a drilling derrick supported by a drill floor in a Jackup drilling unit which extends beyond the Jackup hull by a cantilever to drill exploration or production wells. Further embodiments provide a drilling rig having a three-rail multi-direction cantilever skidding system employed in a Jackup drilling unit.

One aspect of the present subject matter may provide a multipurpose cantilever skidding frame employable in a drilling rig. In one embodiment, the multipurpose cantilever skidding frame comprises a left frame structure comprising one aft corner structure, one forward corner structure, and one longitudinal skidding foundation structure, where the longitudinal skidding foundation structure integrally couples the aft and forward corner structures to form the left frame structure. The multipurpose cantilever skidding frame may also comprise a right frame structure comprising one aft corner structure, one forward corner structure and one longitudinal skidding foundation structure where the longitudinal skidding foundation structure integrally couples the aft and forward corner structures to form the right frame structure. The cantilever skidding frame may also include two connection beams for connecting the left and right frame structures together to form a rigid structure of the multipurpose cantilever skidding frame. The cantilever skidding frame may include a transverse skidding driving mechanism connected to each of the aft and forward corner structures to drive the multipurpose cantilever skidding frame together with a cantilever to skid over transverse skidding tracks thereby moving the cantilever in a transverse direction. The cantilever skidding frame may also include a longitudinal skidding driving means connected to each of the left and right frame structure so as to drive the cantilever in a longitudinal direction to skid over the aft and forward corner structures.

In another embodiment, a multipurpose cantilever skidding frame is provided having an aft corner structure with a stern pad comprising a high lead bronze pad and a support pad with two top lips where the high lead bronze pad is locked on the support pad by a locking plate or bolt, where the support pad is welded to the aft corner structure, and where the stern pad allows the cantilever to skid over the aft corner structure smoothly. In a further embodiment, a multipurpose cantilever skidding frame is provided having an aft corner structure with wedges being slotted into the aft corner structure for locking the aft corner structure against the top edges of the skidding track. In such an embodiment, four locking plates for locking the wedges may also be provided, and upper and lower bronze plates may be provided for allowing the aft corner structure to smoothly skid along the skidding track.

In another embodiment, a multipurpose cantilever skidding frame is provided having a forward corner structure with a hold-down claw where the hold-down claw comprises a compression support pad directly welded or integrated with the forward corner structure for providing support for a cantilever. This embodiment may further include a pair of locking frames disposed at both ends of the compression support pad and may be directly welded to the forward corner structure. This embodiment may also include a pair of clamps having a C-shape configuration with an upper end having an inward step for locking the upper surface of a cantilever bottom beam of the cantilever and a lower end for locking a step surface of the compression support pad so the cantilever bottom beams slide inside the hold-down clamps without overturning. In a further embodiment, a multipurpose cantilever skidding frame is provided having a forward corner structure with wedges being slotted into the forward corner structure for locking the forward corner structure against the top edges of the skidding track. In such an embodiment, four locking plates for locking the wedges may also be provided, and upper and lower bronze plates may be provided for allowing the forward corner structure to smoothly skid along the skidding track. A plurality of parking pins may be included for securing the multipurpose cantilever skidding frame at a parking position. In an additional embodiment, a multipurpose cantilever skidding frame is provided having a connection mechanism between the left and right frame structures. In another embodiment, a multipurpose cantilever skidding frame may include a friction reducing mechanism, such as but not limited to, an arrangement of bronze pads affixed to the transverse skidding track and/or to the cantilever beams with or without bronze pads provided on the corner structures.

Additional embodiments provide a drilling rig having a rig platform for providing working space and tools, a pair of parallel transverse skidding tracks safely secured onto the top of the rig platform, and a multipurpose cantilever skidding frame slidably disposed onto the top of the pair of parallel transverse skidding tracks where the multipurpose cantilever skidding frame comprises a left frame structure comprising one aft corner structure, one forward corner structure, and one longitudinal skidding foundation structure. The longitudinal skidding foundation structure may be integrally coupled to the aft and forward corner structures to foam the left frame structure. The frame may also include a right frame structure with one aft corner structure, one forward corner structure, and one longitudinal skidding foundation structure where the longitudinal skidding foundation structure integrally couples the aft and forward corner structures to form the right frame structure. Two connection beams may be provided for connecting the left and right frame structure together to form a rigid structure for the multipurpose cantilever skidding frame. A transverse skidding driving mechanism connected to each of the aft and forward corner structures may also be provided, and a longitudinal skidding driving mechanism connected to each of the left and right frame structure may be provided as well. The cantilever may be slidably disposed onto the top of the multipurpose cantilever skidding frame and allowed to skid in both longitudinal and transverse directions. In some embodiments, a drilling module may be disposed on the top of the cantilever for performing drilling over wells. In such embodiments, the cantilever may be driven by the longitudinal skidding driving mechanism to skid over the aft and forward corner structures in a longitudinal direction and may be driven by the transverse skidding driving mechanism to skid the multipurpose cantilever skidding frame in a transverse direction.

In another embodiment, an exemplary drilling rig may include an aft corner structure having a stern pad with a high lead bronze pad and a support pad with two top lips where the high lead bronze pad may be locked on the support pad by a locking plate or bolt, the support pad may be welded to the aft corner structure, and where the stern pad allows the cantilever to skid over the aft corner structure smoothly. In a further embodiment, the drilling rig may include an aft corner structure with wedges being slotted into the aft corner structure for locking the aft corner structure against the top edges of the skidding track and may also include locking plates for locking the wedges and upper and lower bronze plates for allowing the aft corner structure to smoothly skid along the skidding track. In another embodiment, an exemplary drilling rig may include a friction reducing mechanism including, but not limited to, an arrangement of bronze pads affixed to the transverse skidding track and to the cantilever beams with or without bronze pads provided on the corner structures.

In another embodiment, a drilling rig is provided having a forward corner structure with a hold-down claw where the hold-down claw comprises a compression support pad directly welded or integrated with the forward corner structure for providing support for a cantilever. A pair of locking frames may be disposed at both ends of the compression support pad and directly welded to the forward corner structure. Further, a pair of clamps may be provided having a C-shape configuration with an upper end with an inward step for locking the upper surface of a cantilever bottom beam of the cantilever, and a lower end for locking a step surface of the compression support pad, so the cantilever bottom beams can slide inside the hold-down clamps without overturning. In a further embodiment, the drilling rig may include a forward corner structure with wedges being slotted into the forward corner structure for locking the forward corner structure against the top edges of the skidding track, four locking plates for locking the wedges, and upper and lower bronze plates for allowing the forward corner structure to smoothly skid along the skidding track. A plurality of parking pins may also be included for securing the multipurpose cantilever skidding frame at a parking position.

In another embodiment of the present subject matter, the left and right frame structures of the drilling rig may be connected using connection beams with bolting or welding after both of the left and the right frame structure are installed on respective tracks.

In a further embodiment of the present subject matter, the cantilever may include a pair of beams disposed at the bottom of the cantilever and a pair of skid beams each disposed on either longitudinal side of the cantilever, each beam guiding the longitudinal skidding driving mechanism securely disposed on the multipurpose cantilever skidding frame. In yet another embodiment of the present subject matter, a drilling module may be enabled by a drill floor skid frame to slidably move in a transverse direction related to the rig platform.

In a further embodiment, the drilling rig may comprise a cantilever mud return trough fixedly mounted on one side of the cantilever where the cantilever mud return trough allows mud from the cantilever to be returned to a mud tank inside a hull of the drilling rig. In some embodiments, the cantilever mud return trough may comprise one or more outlets at different positions related to the range of the longitudinal skidding distance of the cantilever where the mud from one outlet drops into a longitudinal mud return trough fixedly mounted on one side of the multipurpose cantilever skidding frame, the mud from the longitudinal mud return trough drops to a transverse mud return trough fixedly mounted on the rig platform, and the mud is disposed into a mud tank inside the hull.

Another aspect of the present subject matter provides a multi-direction direct cantilever skidding system suitable for an offshore drilling system. In some embodiments, the multi-direction direct cantilever skidding system comprises a pair of aft guides disposed onto an aft transverse skidding rail where the aft guides are movable along the aft transverse skidding rail. The system further includes a pair of forward hold down guides disposed onto a forward transverse skidding rail where the forward hold down guides are movable along the forward transverse skidding rail. The system includes a plurality of skid driving mechanism, a plurality of longitudinal skidding supports slidably attached onto a cantilever, and a plurality of transverse skidding supports slidably attached onto the aft and forward transverse skidding rails. The aft and forward guides may thus accommodate the cantilever and enable the aft and forward transverse rails to directly support the cantilever where each of the plurality of the skid driving mechanisms is coupled at one end with one of the aft or forward guides and at the other end with one of the longitudinal or transverse skidding supports to move the cantilever in both longitudinal and transverse directions.

In another embodiment of the multi-direction direct cantilever skidding system, each of the forward hold down guides may comprise a portion located outside of the cantilever having a horizontal central portion and two vertical portions integrally coupled with the two ends of the horizontal central portion. The system further includes one inner part located under the cantilever where the inner part has a horizontal central portion and two vertical portions integrally coupled with the two ends of the horizontal central portion. The system also includes a pair of locking mechanisms to lock the outer and inner parts when the outer and inner parts are assembled whereby the outer part includes a longitudinal coupling structure at one end for coupling to one of the plurality of the skid driving mechanism thereby allowing longitudinal movement of the cantilever. This system also includes an extension at both ends to securely lock the outer and inner parts when assembled, a transverse or lower claw at both vertical portions formed at the junction of the bottom of the horizontal central portion and the top of the vertical portions for enabling the hold down guide to wrap the top edges of the aft and forward transverse skidding rails, and a longitudinal or upper claw formed at the horizontal central portion for enabling the hold down guide to wrap the bottom edges of the cantilever beam. In such a system, the inner part may be configured similar to the outer part except for transverse coupling structures each located at the inner side of each end for coupling to skid driving mechanism for allowing the transverse movement of the cantilever. In a further embodiment of the multi-direction direct cantilever skidding system, the locking mechanism may be identical or have a different design for each of the two ends. Exemplary locking mechanisms may be clamps, large bolts or a combination of bolts, clamps and interlocking arrangements. Exemplary skid driving mechanisms may be hydraulic skidding cylinders and the like.

Another aspect of the present subject matter provides a Jackup drilling unit or other mobile platform suitable for an offshore drilling system. In one such embodiment, the drilling unit includes an aft transverse skidding rail and a forward transverse skidding rail where both rails are securely disposed onto a Jackup deck and configured in parallel. The unit may further include a cantilever, a drilling floor slidably disposed on the cantilever, and an exemplary multi-direction direct cantilever skidding system. Exemplary aft and forward rails may be provided with different cross section designs. Further, exemplary skidding pads may be disposed onto the rails to provide reduced friction between the rails and the cantilever.

Another aspect of the present subject matter provides a three-rail arrangement of cantilever skidding guides. In such an embodiment, the rails may be arranged with one rail near the aft of a drilling system and two rails, one for carrying compression loads during transverse skidding and one for uplift, located at a more forward location. In one embodiment, aft cantilever skidding guides may be disposed on an aft transverse skidding rail, forward cantilever skidding guides may be disposed on a forward transverse skidding rail, and forward hold down guides may be disposed on a forward hold down rail. Each of the forward and aft cantilever skidding guides include inner and outer parts for accommodating the lower flange of a cantilever beam, a slot for accommodating a transverse skidding rail, and a plurality of locking mechanisms. Upon assembly of the outer and inner parts, the locking mechanism may secure the outer and inner parts into a rigid structure. This arrangement further includes a plurality of skid driving mechanisms, a plurality of longitudinal skidding supports slidably attached onto a cantilever, and a plurality of transverse skidding supports slidably attached onto the aft and forward transverse skidding rails. The aft and forward cantilever skidding guides may be configured to accommodate the cantilever and enable the aft and forward skidding rails to directly support the cantilever during transverse skidding. Each of the skid driving mechanisms may be coupled at one end with one of the aft or forward cantilever skidding guides and at the other end with one of the longitudinal or transverse skidding supports to move the cantilever in a longitudinal or transverse direction while being supported on the transverse skidding rails. The forward hold down guide may include inner and outer parts having a slot for accommodating the lower flange of a cantilever beam, an upper claw for wrapping the lower flange of a cantilever, a slot for accommodating a forward hold down rail, and a lower claw for wrapping the top edges of the forward hold down rail. A plurality of locking mechanisms may also be provided where the outer part and inner part are assembled into a rigid structure by the locking mechanism.

In another embodiment, the outer and inner parts of the cantilever skidding guides may include end flanges and when assembled, the locking mechanism exerts secure forces on the end flanges. Another embodiment includes a Jackup drilling unit having a forward hold down rail, a forward transverse skidding rail; a forward cantilever skidding guide slidably disposed onto the forward skidding rail and a forward hold down guide slidably disposed on a forward hold down rail. In some embodiments, the Jackup drilling unit includes an aft transverse rail, an aft cantilever skidding guide, a cantilever, and a drilling module where the aft cantilever skidding guide is slidably disposed onto the aft transverse skidding rail, the cantilever is slidably engaged with the upper slot of the cantilever skidding guide while being directly supported by the forward transverse skidding and aft transverse skidding rails, and the drilling unit is slidably disposed onto the top of the cantilever. In yet another embodiment, the Jackup drilling unit may include a plurality of driving mechanisms coupled with the longitudinal and transverse coupling structures to drive the cantilever in both longitudinal and transverse directions.

Further embodiments of the present subject matter provide an offshore drilling system having a platform with a deck and a drilling unit comprising a forward hold down transverse rail and a forward transverse skidding rail where the forward hold down and forward transverse skidding rails are securely disposed onto the deck. The system further includes a forward cantilever skidding guide slidably disposed onto the forward transverse skidding rail and a forward hold down guide slidably disposed on the forward hold down rail.

In an additional embodiment, the forward cantilever sliding guide may be combined with the forward hold down guide disposed on both the forward transverse sliding rail and the forward hold down rail such that the two components are connected to move together along their respective rails. In such an embodiment the forward cantilever skidding guide end of the combined guide may be used to guide the cantilever during transverse skidding, and the forward hold down end of the guide may be used during longitudinal skidding to provide hold down forces with the cantilever extended.

The objectives and advantages of the claimed subject matter will become apparent from the following detailed description of preferred embodiments thereof in connection with the accompanying drawings.

BRIEF DESCRIPTION OF THE DRAWINGS

Other objects, features, and advantages of the present subject matter will be apparent from the following description when read with reference to the accompanying drawings. In the drawings, like reference numerals denote corresponding parts throughout the several views.

DETAILED DESCRIPTION OF THE DRAWINGS

Figure 1:
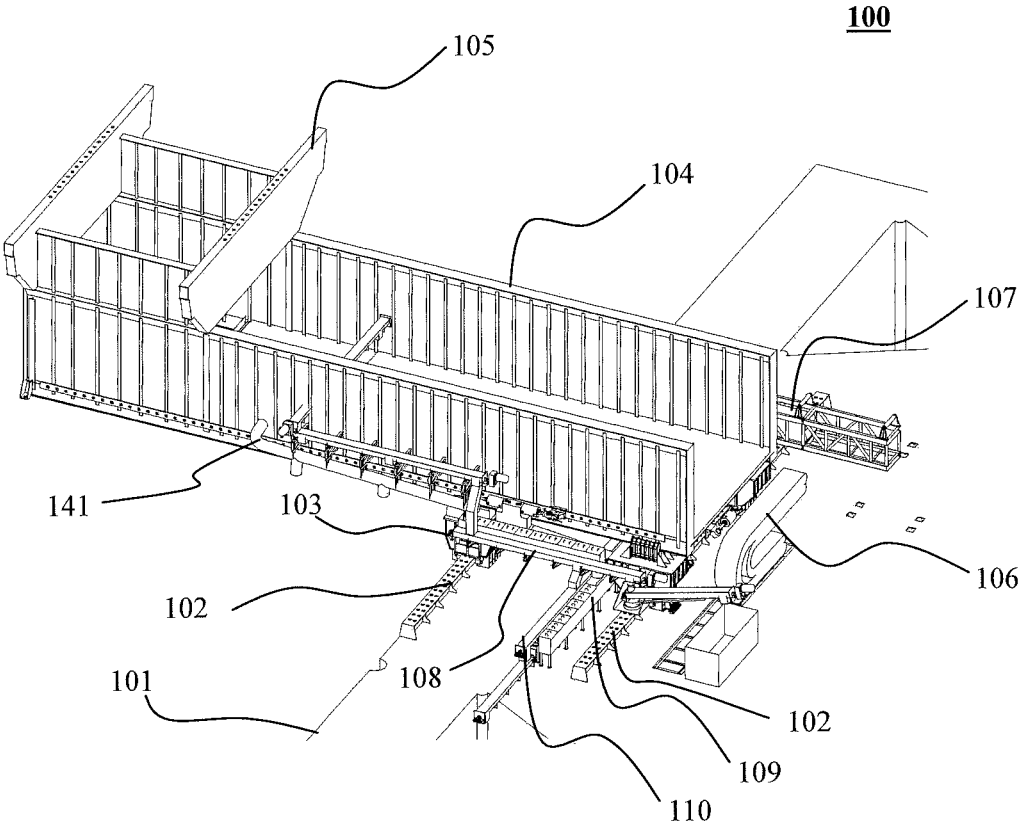
FIG. 1 is an isometric view of a portion of a drilling rig employing a multipurpose cantilever skidding frame in accordance with some embodiments of the present subject matter.

With reference to the figures, where like elements have been given like numerical designations to facilitate an understanding of the present subject matter, the various embodiments of a multi-direction direct cantilever skidding system are described.

It should be noted that the figures are not necessarily to scale and certain features may be shown exaggerated in scale or in somewhat schematic form in the interest of clarity and conciseness. In the description, relative terms such as "horizontal," "vertical," "left," "right," "up," "down," "aft," "forward," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. When only a single machine, device or apparatus is illustrated, the same terms shall also be taken to include any collection of machines that individually or jointly execute a set (or multiple sets) of instructions to perform any one or more of the methodologies discussed herein. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures. While the term "Jackup" may be employed throughout this description to describe a drilling unit, the scope of the claims appended herewith should not be so limited as the inventions described herein are applicable to any number or type of mobile platforms. While the terms "skid" or "skidding" may be employed throughout this description to describe movement of a component or article in a predefined or constrained direction, the scope of the claims appended herewith should not be so limited as such movement may be in any direction depending upon the use of this term and its relationship to a respective component.

FIG. 1 is an isometric view of a portion of a drilling rig employing a multipurpose cantilever skidding frame in accordance with some embodiments of the present subject matter. With reference to FIG. 1, a drilling rig 100 is illustrated having a rig platform 101 and a pair of parallel transverse skidding tracks 102 affixed to the top of the rig platform 101. A multipurpose cantilever skidding frame 103 may be slidably disposed on the pair of parallel transverse skidding tracks 102, and a cantilever 104 may be slidably disposed on the multipurpose cantilever skidding frame 103. In some embodiments, a drilling module or unit 105 may be slidably disposed on the cantilever 104. The rig platform 101 may be any conventional drilling rig and may provide working space and support for, among other things, an exemplary cantilever 104. Of course, the rig platform 101 so illustrated should not limit the scope of the claims appended herewith as any type of rig platform may be utilized with embodiments of the present subject matter. The parallel transverse skidding tracks 102 may be manufactured from any suitable materials having a desired durability and strength such as, but not limited to, steel, iron, and other metals and alloys. The parallel transverse skidding tracks 102 may be secured onto the rig platform 101 by any suitable securing mechanisms, e.g., welding, bolts, and the like. A transverse drag chain 106 and a longitudinal drag chain 107 may be employed to transfer power and/or materials within the hull of the rig platform 101 to any equipment inside an exemplary cantilever 104.

In some embodiments, exemplary cantilevers 104 may include a fluid or mud system for controlling and directing the flow of fluids and/or material (e.g., mud and the like) from the cantilever 104. In some embodiments, the system may include a mud return from the cantilever 104 to a mud tank (not shown) inside the hull of the rig platform 101. For example, clean mud or material after treatment may first flow to a cantilever mud return trough 141 affixed on one side of the cantilever 104. The cantilever mud return trough 141 may, in some embodiments, have a plurality of outlets at different positions. In the embodiment depicted in FIG. 1, three outlets are illustrated. In such embodiments, the positions of the outlet of the cantilever mud return trough 141 may be a function of the longitudinal skidding distance of the cantilever 104. The material or mud from one outlet (i.e., depending upon the longitudinal skidding distance of the cantilever 104) of the cantilever mud return trough 141 may descend into a longitudinal mud return trough 108 affixed on one side of the multipurpose cantilever skidding frame 103. In some embodiments, the length of the longitudinal mud return trough 108 may define the working range of any outlet of the cantilever mud return trough 141. The material or mud provided from the longitudinal mud return trough 108 may descend to a transverse mud return trough 109 affixed and mounted on the rig platform 101 whereby the material or mud is fed into mud tanks (not shown) inside the hull of the rig platform. This feeding may be gravitational or may be mechanically assisted by pumps. In various embodiments, the length of the transverse mud return trough 109 may be equal to or greater than the transverse skidding distance of the cantilever 104. In additional embodiments, a cutting transfer screw 110 may provide any cuttings from the cantilever 104 to a respective seabed or to a portable cutting skip (not shown) on the platform 101.

Figure 2:
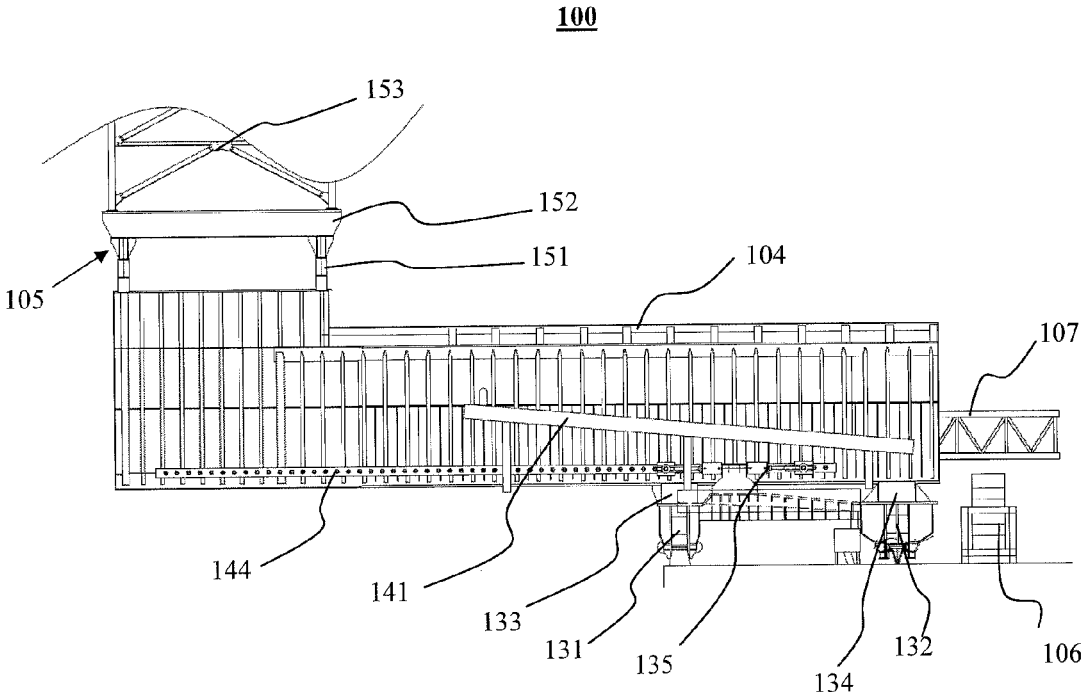
FIG. 2 is a longitudinal side view of a portion of the drilling rig of FIG. 1 in accordance with some embodiments of the present subject matter.
Figure 3:
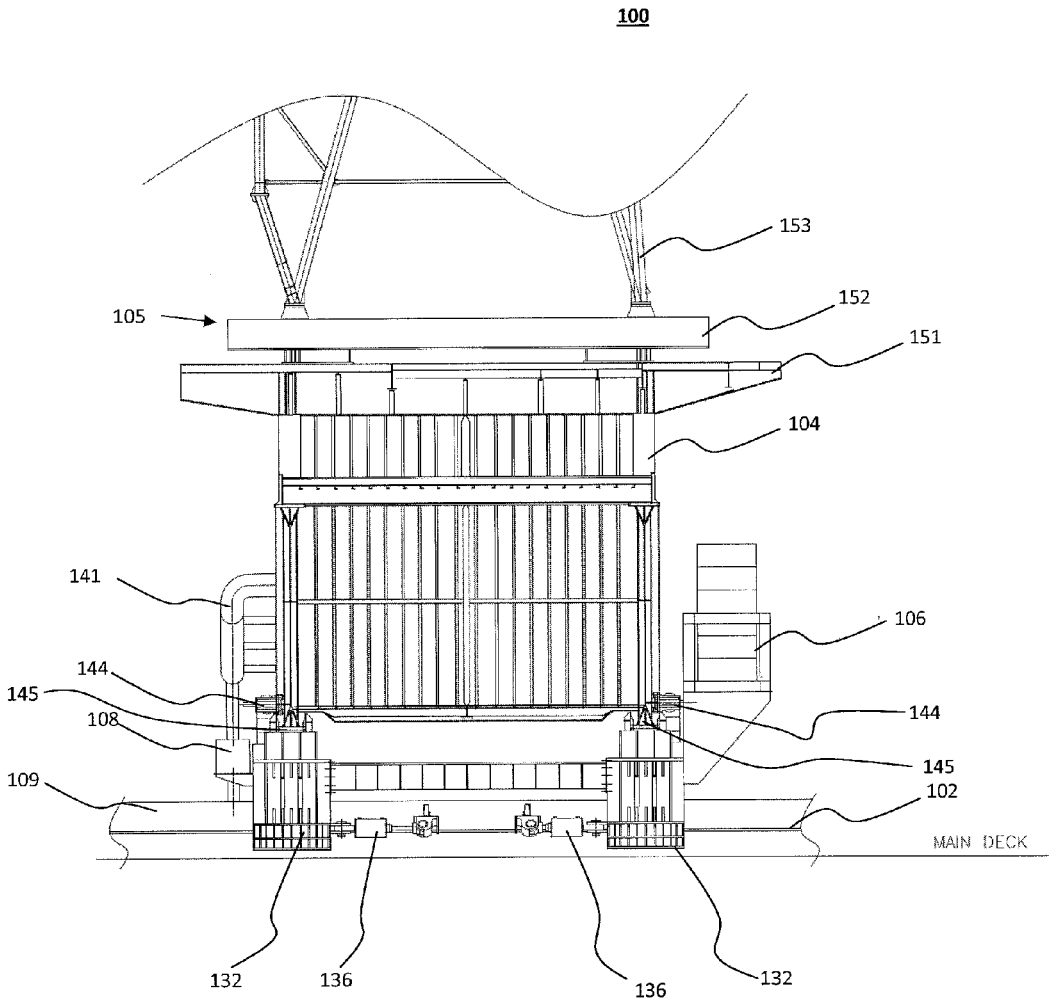
FIG. 3 is a transverse side view of a portion of the drilling rig of FIG. 1 in accordance with some embodiments of the present subject matter.

FIG. 2 is a longitudinal side view of a portion of the drilling rig of FIG. 1 in accordance with some embodiments of the present subject matter. FIG. 3 is a transverse side view of a portion of the drilling rig of FIG. 1 in accordance with some embodiments of the present subject matter. With reference to FIGS. 2 and 3, an exemplary drilling rig 100 may further include a drilling module 105 having a drill floor skid frame 151 slidably disposed at the distal end of the cantilever 104. A drill floor 152 may be secured to the drill floor skid frame 151 with a derrick 153 disposed on the drilling floor 152. Exemplary drilling modules 105 may slidably move in a transverse direction in relation to the rig platform 101 as a function of the drill floor skid frame 151. In various embodiments, the cantilever 104 may include a plurality of beams 145 disposed at the bottom of the cantilever 104. The cantilever 104 may also include a pair of skid beams 144 each disposed on a longitudinal side of the cantilever 104 and each skid beam 144 guiding the output of a respective longitudinal skidding driving mechanism 135 disposed on the multipurpose cantilever skidding frame 103. For example, holes or other suitable guidance mechanisms (e.g., rails and the like) in the skid beams 144 may be employed to transfer the pushing/pulling force imparted by the skidding driving mechanism 135 to move the cantilever 104 and/or to lock the cantilever 104 when stationary.

Exemplary multipurpose cantilever skidding frames 103 according to some embodiments of the present subject matter may be a rigid structure used to support the cantilever 104 and used as a platform to support material (e.g., mud) return and containment lines, cutting return lines, longitudinal drag chains 107, as well as accommodate other components and equipment conventionally utilized on such drilling rigs. Exemplary multipurpose cantilever skidding frames 103 may slide along the parallel tracks 102 using a plurality of transverse skidding driving mechanisms 136. In the depicted embodiment, four transverse skidding driving mechanisms 136 are illustrated connected to four corner structures of the skidding frame 103, however, the claims appended herewith should not be so limited as any number and configuration of driving mechanisms may be employed in embodiments of the present subject matter to achieve the advantages described herein. In some embodiments, the cantilever 104 may slide along the multipurpose cantilever skidding frame 103 using two longitudinal skidding driving mechanisms 135. In such an embodiment, the four corner structures of the multipurpose cantilever skidding frame 103 may be strong enough to bear the compression and tension loads during normal drilling and/or cantilever skidding conditions. These four corner structures may include two aft corner structures 131 and two forward corner structures 132. These structures 131, 132 may be substantially similar or may be different depending upon the loads encountered during drilling operations. In some embodiments, to ensure a smooth cantilever skidding, a stern pad 133 may be affixed on each aft corner structure 131 and a hold-down claw 134 provided on top of each forward corner structure 132 (see FIGS. 5-7). In other embodiments, friction may be reduced on the stern pads and hold-down claws by various methods. Such friction reducing means may include, but are not limited to, lower friction materials such as bronze pads or mechanical mechanisms such as rollers and the like. As the cantilever 104 is skidding or moving longitudinally, the beams 145 may slide along the stern pads 133 and hold-down claws 134 whereby the total weight and drilling load of the cantilever 104 is substantially transferred by the beams 145 to the stern pads 133 and hold-down claws 134 and thus to the corner structures 131, 132. In another embodiment, a multipurpose cantilever skidding frame may include a friction reducing mechanism, such as but not limited to, an arrangement of bronze pads affixed to the transverse skidding track and/or to the cantilever beams with or without bronze pads provided on the corner structures.

Figure 4:
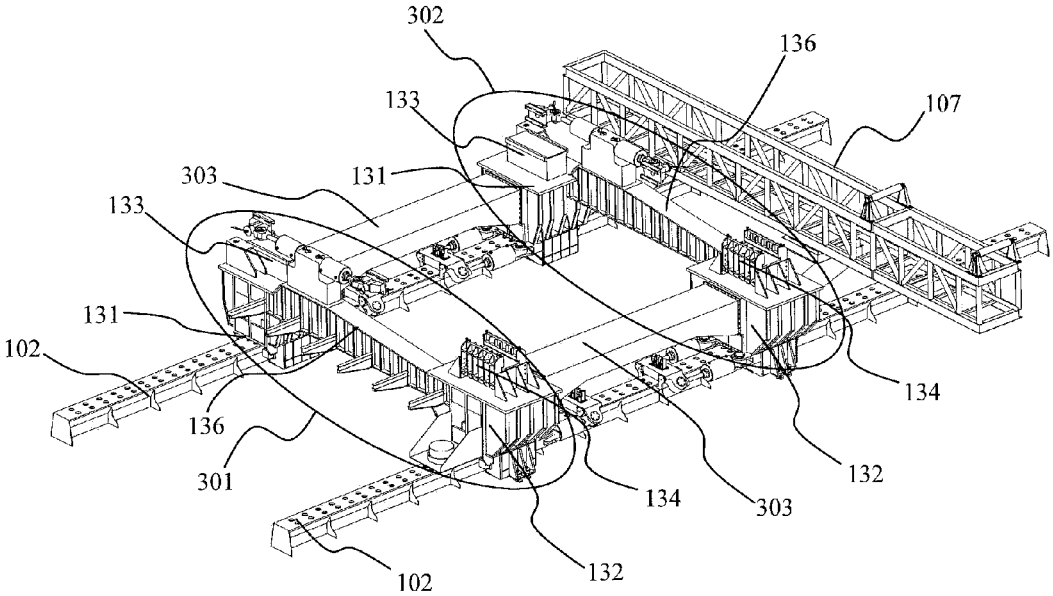
FIG. 4 is an isometric view of a multipurpose cantilever skidding frame in accordance with various embodiments of the present subject matter.
Figure 5:
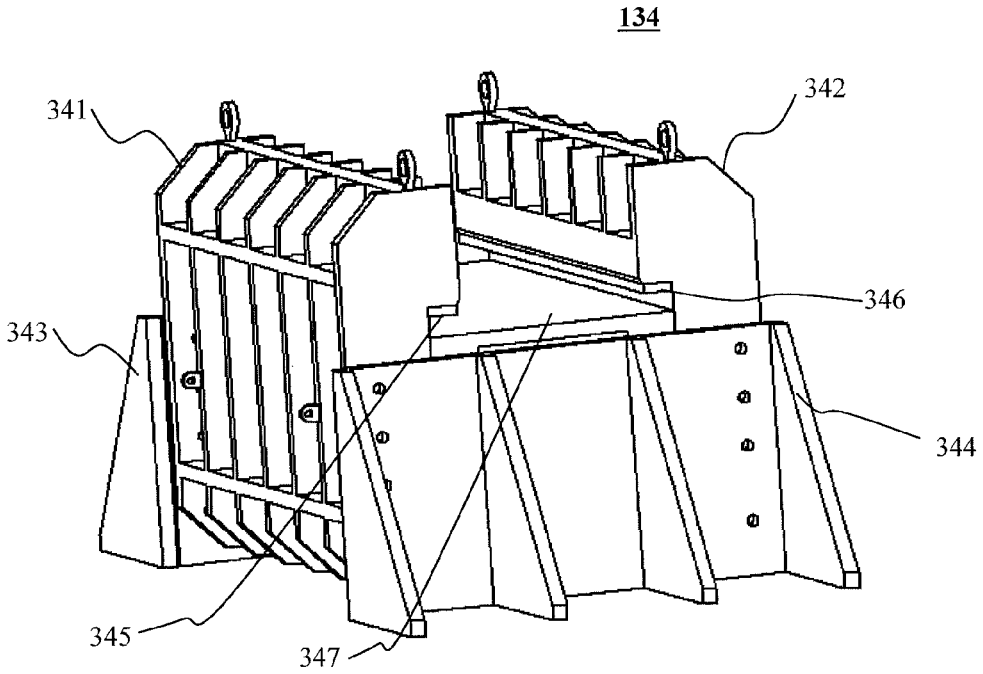
FIG. 5 is an isometric view of a hold-down clamp in accordance with some embodiments of the present subject matter.

FIG. 4 is an isometric view of a multipurpose cantilever skidding frame in accordance with various embodiments of the present subject matter. FIG. 5 is an isometric view of a hold-down clamp in accordance with some embodiments of the present subject matter. With reference to FIGS. 4 and 5, a multipurpose cantilever skidding frame 103 is illustrated in an installed state forming a rigid structure supporting the cantilever 104 during working or skidding conditions of the drilling rig. During installation, a first frame structure 301 (e.g., left frame structure) may be formed by coupling an aft corner structure 131 and a forward corner structure 132 using a longitudinal skidding foundation structure 136. Similarly, a second frame structure 302 (e.g., a right frame structure) may be formed by coupling another aft corner structure 131 and another forward corner structure 132 using another longitudinal skidding foundation structure 136. The first and second frame structures 301, 302 may be connected using two beams 303. This connection may be made using conventional fastening mechanisms, e.g., bolts, welds, etc., after both the first and second frame structures 301, 302 are installed on the tracks or rails 102. In some embodiments, the first and second frame structures 301, 302 may further include one or more stern pads 133. Locking frames 343, 344 together with compression support pads 347 of exemplary hold-down claws 134 may be integrated in the first and second frame structures 301, 302, respectively, before the first and second frame structures 301, 302 are installed to form an exemplary multipurpose cantilever skidding frame 103. Such an architecture may thus greatly ease the handling and installation of the multipurpose cantilever skidding frame 103. In some embodiments of the present subject matter, the first and second frame structures 301, 302 may be substantially similar to each other. In additional embodiments, these first and second frame structures 301, 302 are unconnected before installation on the skidding tracks 102.

Figure 6:
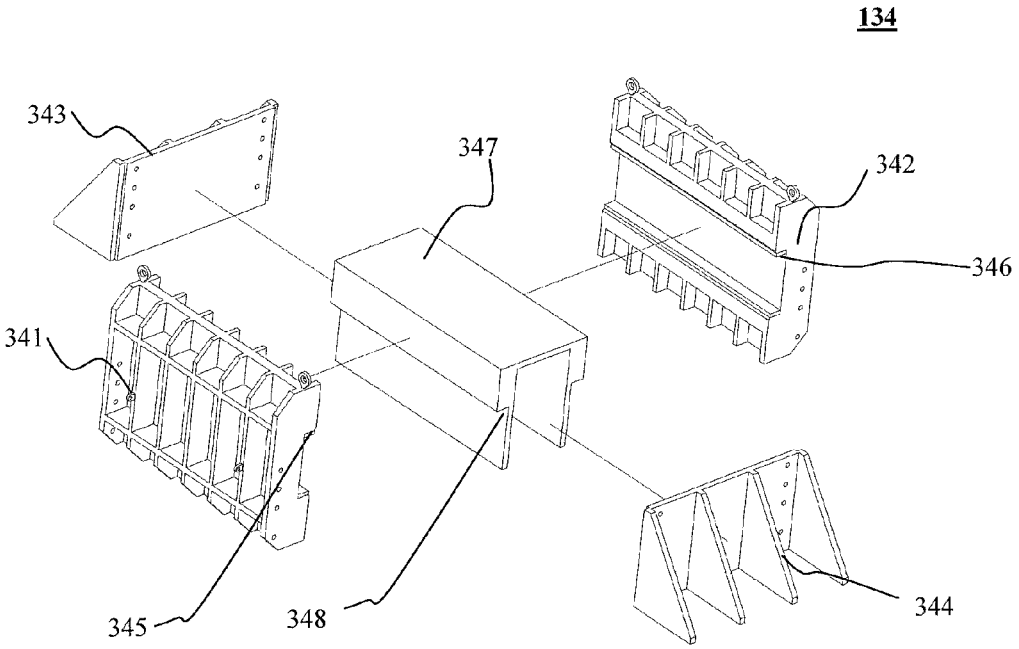
FIG. 6 is an exploded view of the hold-down clamp of FIG. 5.

FIG. 6 is an exploded view of the hold-down clamp of FIG. 5. With reference to FIG. 6 and continued reference to FIG. 5, an exemplary hold-down claw 134 may include a compression support pad 347, a plurality of locking frames 343, 344, and a plurality of hold-down clamps 341, 342. In various embodiments, a pair of locking frames 343, 344 are employed. The compression support pad 347 may be utilized for providing support for the cantilever 104. In some embodiments, the compression support pad 347 may be welded or otherwise integrated with the forward corner structure 132 for providing support for the cantilever 104. The locking frames 343, 344 may be disposed at either or both ends of the compression support pad 347 affixed (e.g., welded or otherwise) to the forward corner structure 132. In certain embodiments of the present subject matter, the hold-down clamps 341, 342 may possess a C-shape configuration having an upper end with respective inward steps 345, 346 for locking the upper surface of the cantilever beam 145. The hold down clamps 341, 342 may also possess a lower end for locking a step surface 348 of the compression support pad 347 so that the cantilever beams 145 can slide inside the hold-down clamps 341, 342 without overturning. Exemplary hold-down clamps 341, 342 may be installed after the cantilever 104 is disposed on the stern pads 133 and/or compression support pad 347. The hold-down clamps 341, 342 may then be locked on the compression support pad 347 by the step surface 348 and may also be secured from lateral or side movement by affixing the device to locking frames 343, 344 (e.g., by bolting, welding and the like).

Figure 7:
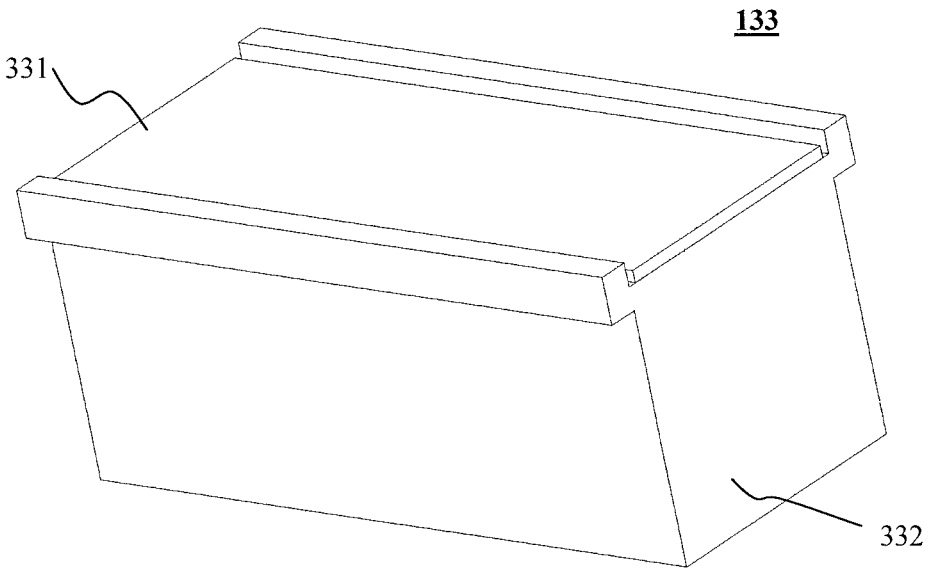
FIG. 7 is an isometric view of a stern pad in accordance with some embodiments of the present subject matter.

FIG. 7 is an isometric view of a stem pad in accordance with some embodiments of the present subject matter. With reference to FIG. 7, an exemplary stem pad 133 may include two or more portions. In some embodiments, the stem pad 133 may include a high lead bronze pad 331 and a support pad 332 having two raised sections thereof (e.g., upper lips, ridges, and the like). The high lead bronze pad 331 may be locked on the support pad 332 by a locking plate, bolt or other fastening mechanism. During longitudinal skidding, an exemplary cantilever 104 may slide along the high lead bronze pad 331 to reduce friction between the cantilever 104 and rail. The support pad 332 may be welded or otherwise affixed to the aft corner structures 131. In some embodiments, the cantilever beam 145 may be secured in the stem pad 133 by the two raised sections of the support pad 332. In another embodiment, an exemplary drilling rig may include a friction reducing mechanism including, but not limited to, an arrangement of bronze pads affixed to the transverse skidding track and to the cantilever beams with or without bronze pads provided on the corner structures.

Figure 8:
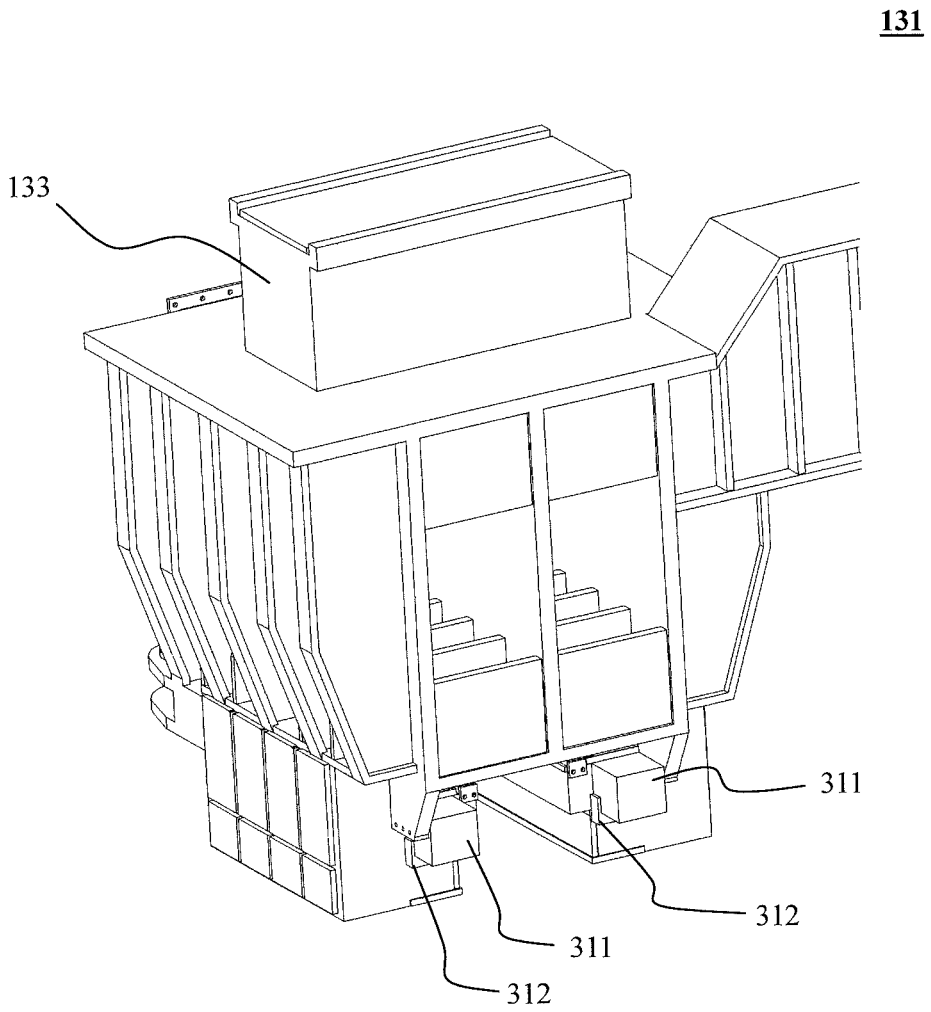
FIG. 8 is an isometric view of an aft corner structure in accordance with some embodiments of the present subject matter.
Figure 9:
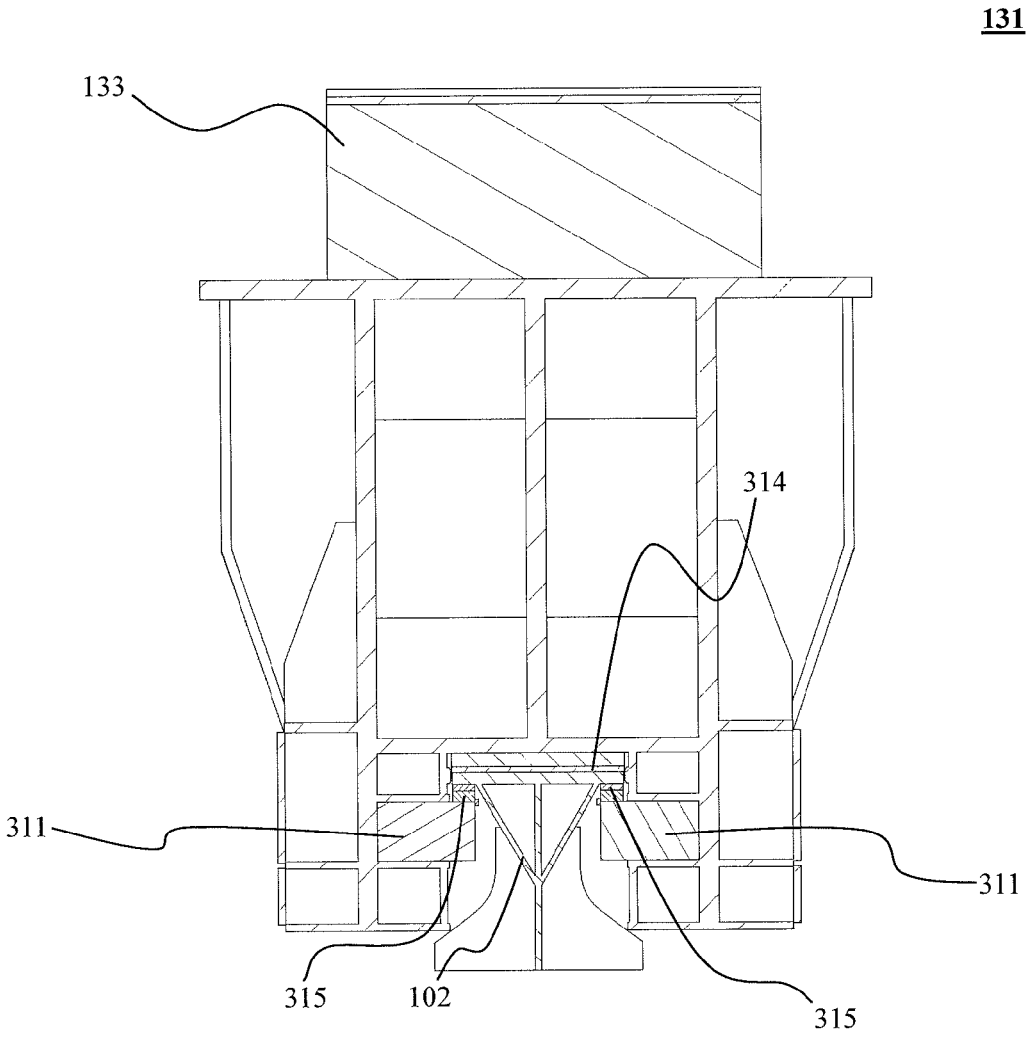
FIG. 9 is a cross-sectional view of the aft corner structure of FIG. 8.

FIG. 8 is an isometric view of an aft corner structure in accordance with some embodiments of the present subject matter. FIG. 9 is a cross-sectional view of the aft corner structure of FIG. 8. With reference to FIGS. 8 and 9, an exemplary aft corner structure 131 may include a stem pad 133, a plurality of wedges 311 slotted into the aft corner structure 131 for locking the aft corner structure 131 against the top edges of the skidding track 102. In a non-limiting embodiment, two wedges 311 are employed. The exemplary aft corner structure 131 may also include a plurality of locking plates 312 for locking the wedges 311. In a non-limiting embodiment, four locking plates are employed. Exemplary aft corner structures 131 may also include an upper bronze plate 314 and one or more lower bronze plates 315 for allowing the aft corner structure 131 to smoothly skid along the skidding track 102. Of course, any number of bronze plates may be utilized in embodiments of the present subject matter, and the specific number illustrated in the figures and described above should not limit the scope of the claims appended herewith.

Figure 10:
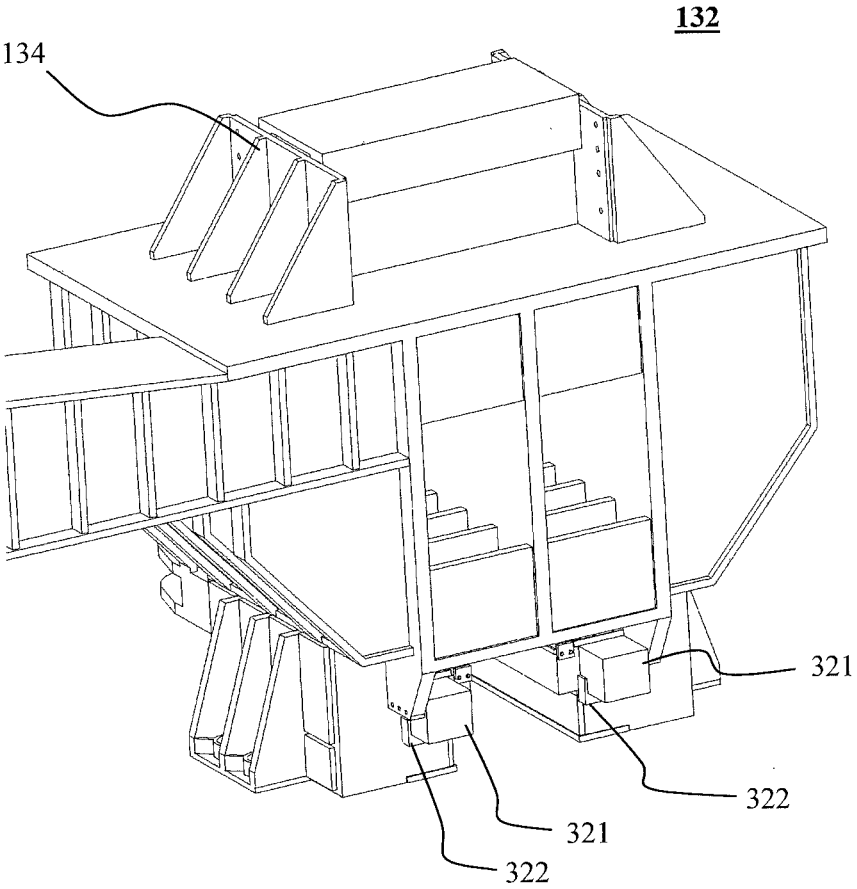
FIG. 10 is an isometric view of a forward corner structure in accordance with some embodiments of the present subject matter.
Figure 11:
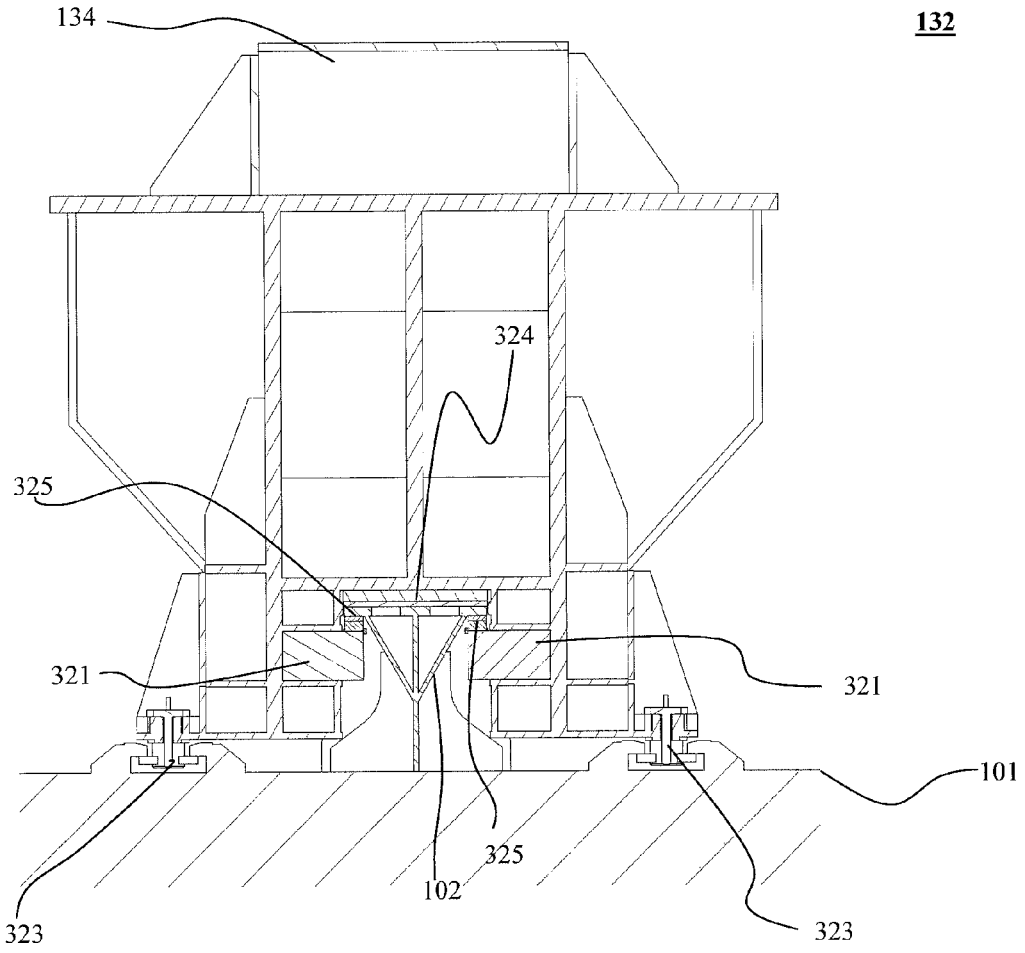
FIG. 11 is a cross-sectional view of the forward corner structure of FIG. 10.

FIG. 10 is an isometric view of a forward corner structure in accordance with some embodiments of the present subject matter. FIG. 11 is a cross-sectional view of the forward corner structure of FIG. 10. With reference to FIGS. 10 and 11, an exemplary forward corner structure 132 may include a hold-down claw 134 and a plurality of wedges 321 slotted into the forward corner structure 132 for locking the forward corner structure 132 against the top edges of the skidding track 102. In a non-limiting embodiment, two wedges 321 are employed. The exemplary forward corner structure 132 may also include a plurality of locking plates 322 for locking the wedges 321. In a non-limiting embodiment, four locking plates are employed. Exemplary forward corner structures 132 may also include an upper bronze plate 324 and one or more lower bronze plates 325 for allowing the forward corner structure 132 to smoothly skid along the skidding track 102. Of course, any number of bronze plates may be utilized in embodiments of the present subject matter, and the specific number illustrated in the figures and described above should not limit the scope of the claims appended herewith. In some embodiments, an exemplary forward corner structure 132 may include a plurality of parking pins 323 to secure the multipurpose cantilever skidding frame 103 in a parking position. Other components or structures may also be utilized for parking or securing the skidding frame 103 in a predetermined position.

In one embodiment of the present subject matter, an exemplary multipurpose cantilever skidding frame 103 may be locked to skidding tracks 102 using four wedges 311 for two aft corner structures 131 and four wedges 321 for two forward corner structures 132. To facilitate installation and fabrication, exemplary wedges may be removable and lockable into predetermined slots in the corner structures 131, 132 utilizing, for example, locking plates 312, 322 or other locking mechanisms. In some embodiments, the wedges may be installed after the first and second frame structures 301, 302 are installed onto the skidding tracks. In a further embodiment, to reduce friction on the track or rail 102, friction reduction mechanisms, such as, but not limited to, bronze plates 314, 315, 324, 325 may be installed between the interface of the track 102 and corner structures 131, 132.

Figure 12:
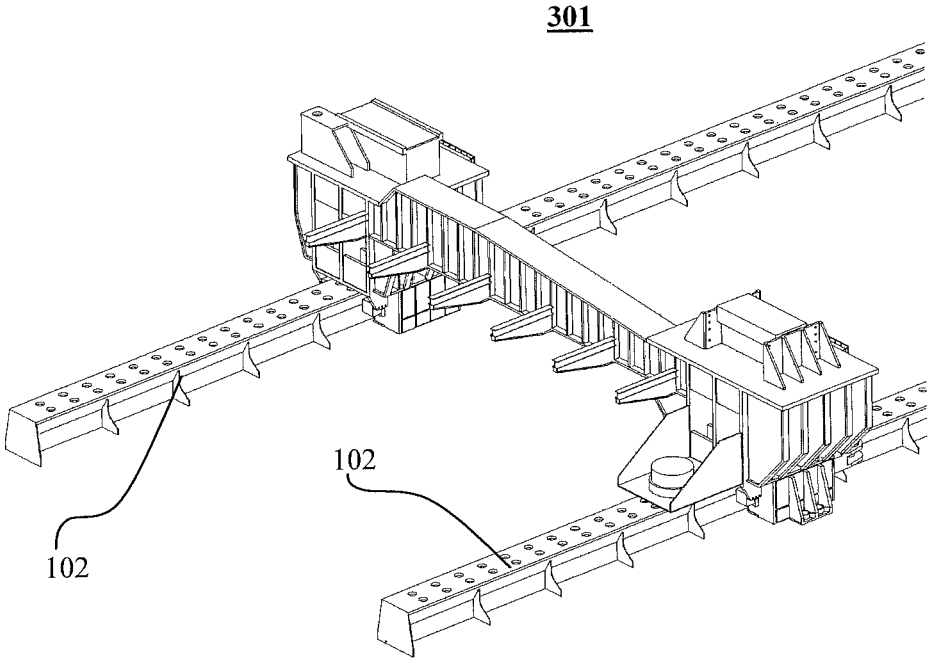
FIGS. 12-18 provide an illustrative process of the installation of a multipurpose cantilever skidding frame and cantilever in accordance with some embodiments of the present subject matter.
Figure 13:
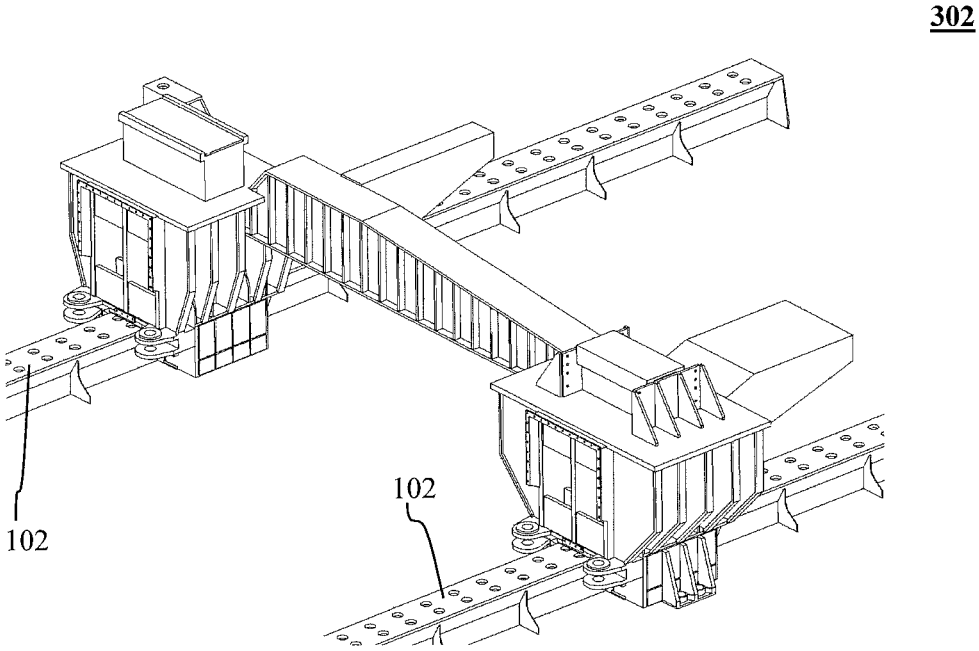
Figure 14:
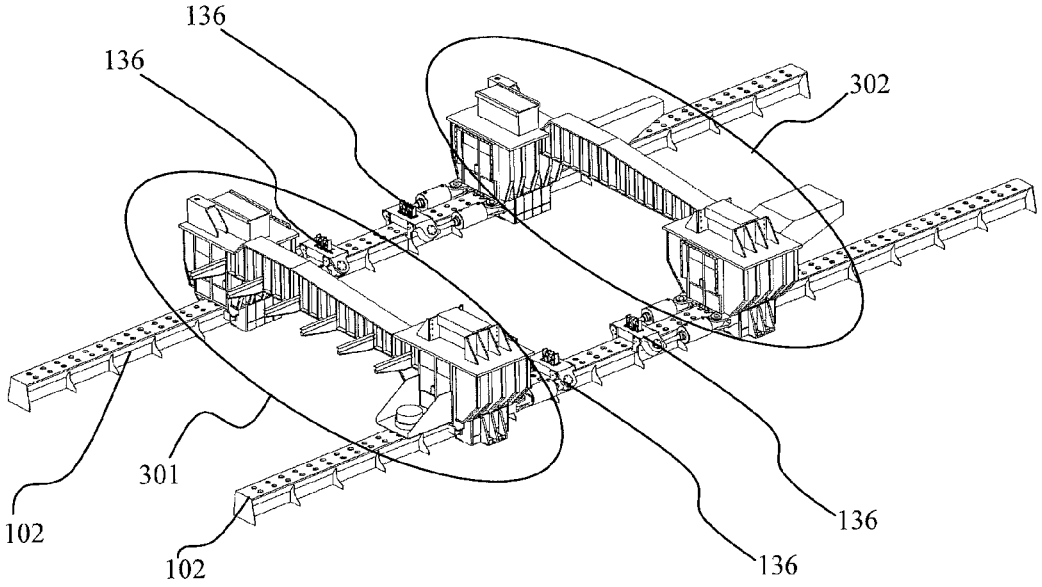
Figure 15:
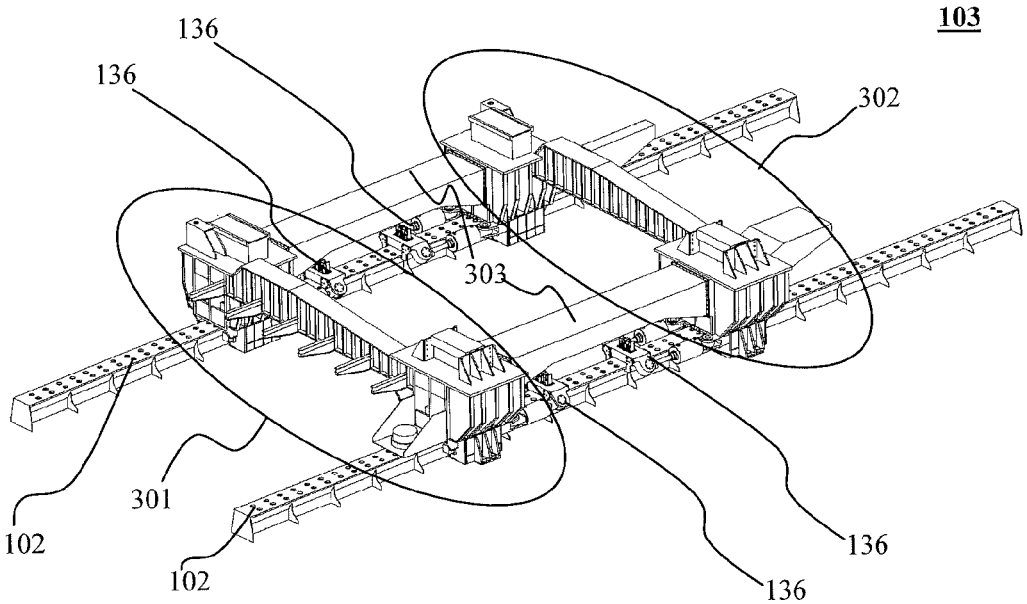
Figure 16:
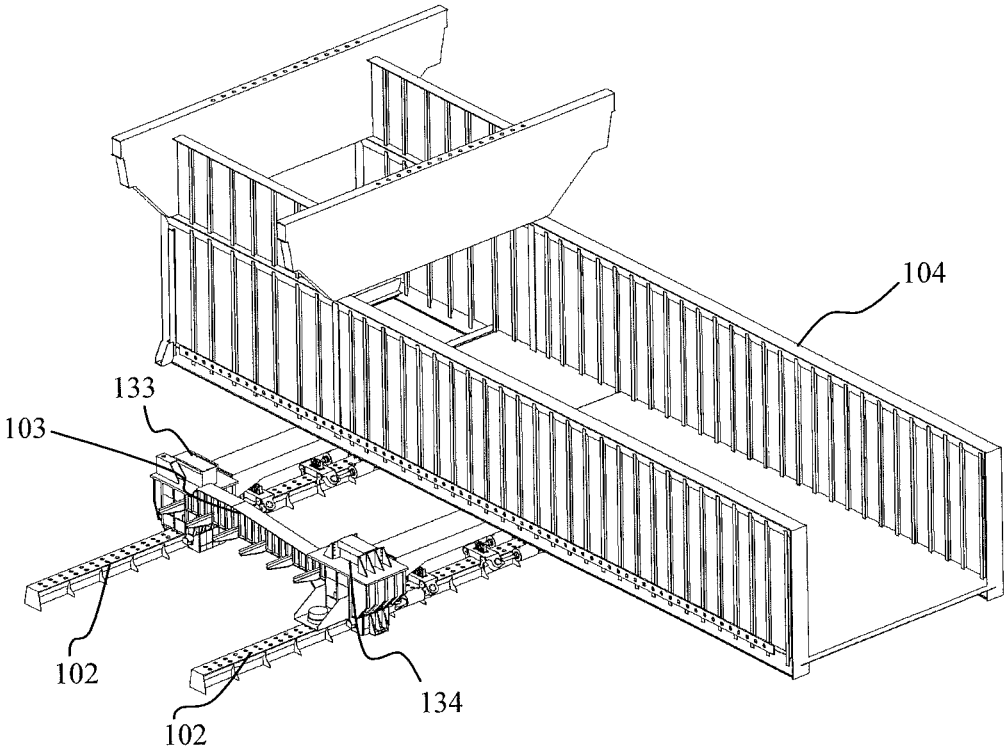
Figure 17:
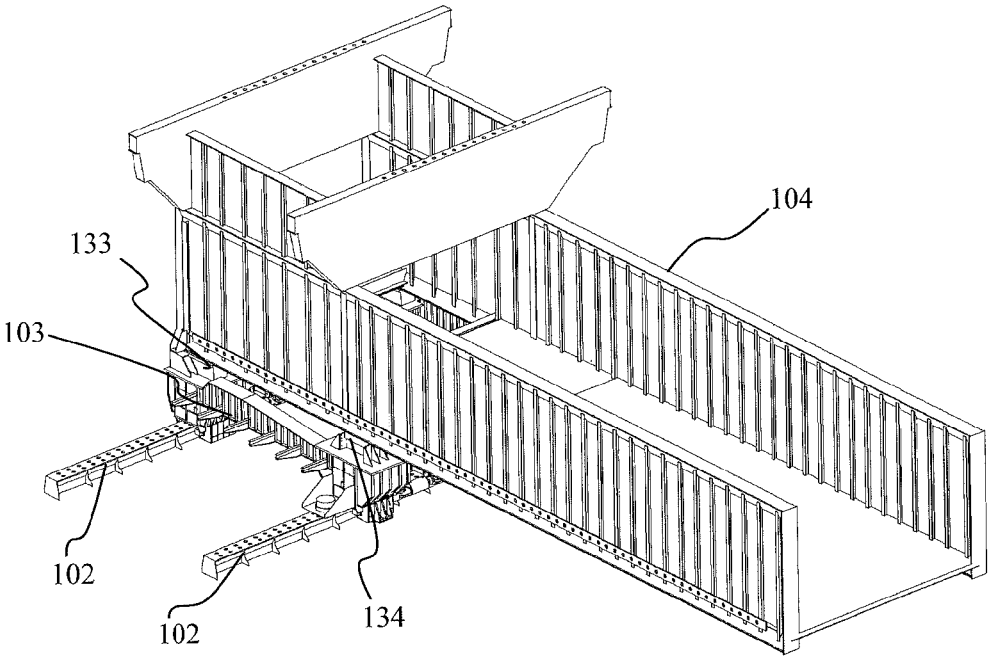
Figure 18:
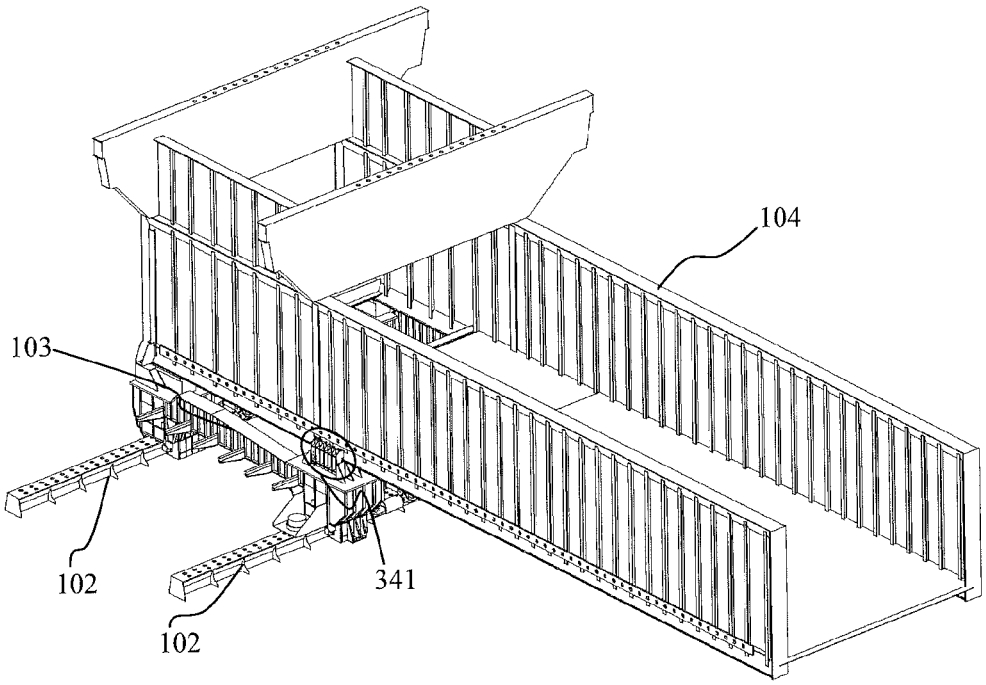

FIGS. 12-18 provide an illustrative process of the installation of a multipurpose cantilever skidding frame and cantilever in accordance with some embodiments of the present subject matter to greatly simplify the installation thereof and reduce risk to those installing the system and cantilever. As illustrated in FIG. 12, the first (e.g., left) frame structure 301 may be lowered onto the transverse skidding tracks 102 without installation of wedges 311, 321, locking plates 312, 322 and/or bronze plates 315, 325. As illustrated in FIG. 13, the second (e.g., right) frame structure 302 may be lowered onto the transverse skidding tracks 102 without installation of wedges 311, 321, locking plates 312, 322 and/or bronze plates 315, 325. In another embodiment, the second frame structure 302 may be installed onto the skidding track 102 prior to installation of the first frame structure 301. After the two frame structures 301, 302 are installed upon the transverse skidding tracks 102, respective wedges, locking plates and/or bronze plates may be installed to ensure that vertical motion of the first and second frame structures 301, 302 is constrained or prevented. As illustrated in FIG. 14, transverse skidding mechanisms 136 may then be installed. With the transverse skidding driving mechanisms 136 installed, the distance between the two frame structures 301, 302 may be adjusted to facilitate beam 303 installation between the two frame structures 301, 302. Upon properly adjusting the distance between the two frame structures 301, 302, connection beams 303 may be installed, as illustrated in FIG. 15, to provide proper rigidity to an exemplary multipurpose cantilever skidding frame 103 and ensure the skidding frame 103 is ready to receive an exemplary cantilever 104. As illustrated in FIGS. 16 and 17, an exemplary cantilever 104 may be installed upon the multipurpose cantilever skidding frame 103. For example, the cantilever 104 may be lifted by a crane or other mechanism (not shown) to align the cantilever with the stern pads 133 and hold-down claws 134 (FIG. 16). The cantilever 104 may then be lowered directly on top of the stern pads 133 and hold-down claws 134 (FIG. 17). Rather than attempting to slide the cantilever 104 through the claws 134, such a step alleviates excess risk, wear and damage to surrounding components and users of the system. As illustrated in FIG. 18, the cantilever 104 has been disposed upon the stem pads 133 and hold-down claws 134. Exemplary hold down clamps 341, 342 may then be installed onto the hold-down claws 134 to secure the cantilever 104 within the hold-down claws 134.

Figure 19:
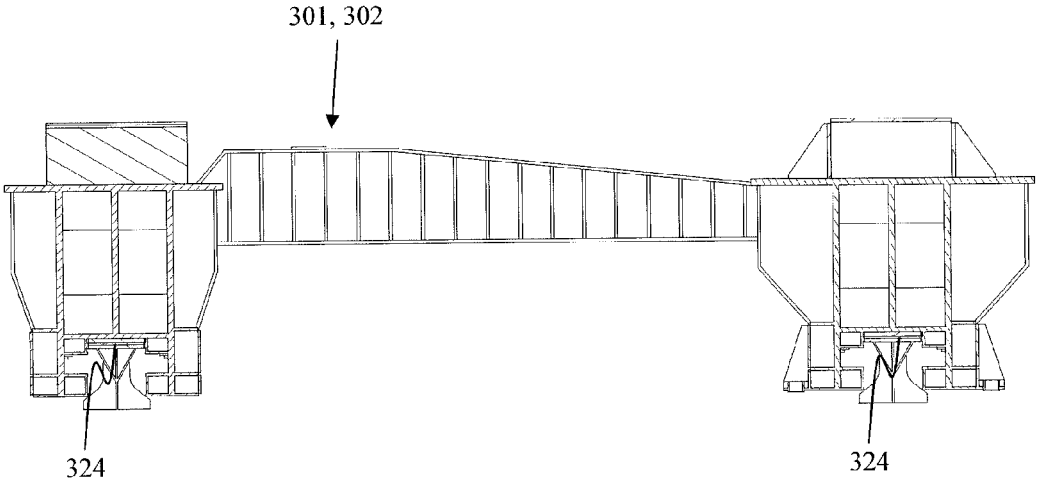
FIG. 19 is a cross-sectional view of an exemplary first/second frame structure in accordance with some embodiments of the present subject matter.
Figure 20:
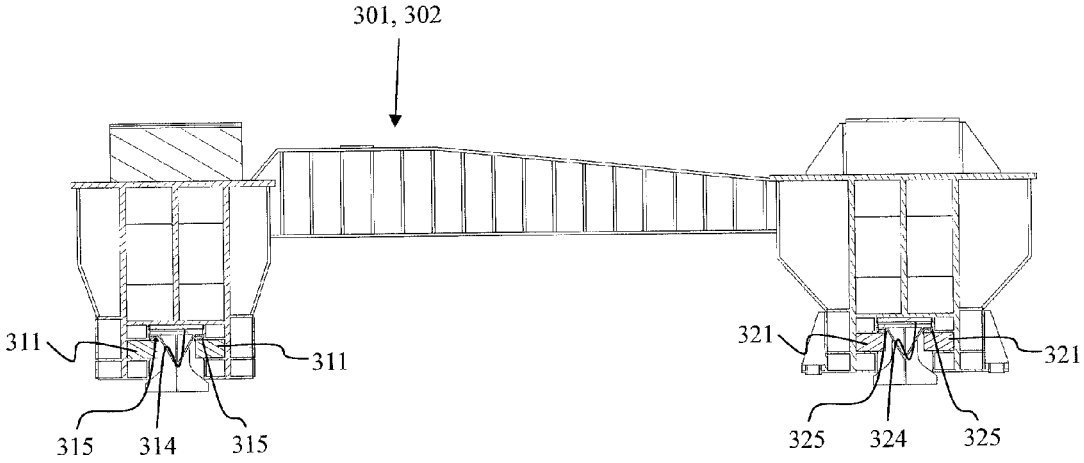
FIG. 20 is a cross-sectional view of another exemplary first/second frame structure in accordance with some embodiments of the present subject matter.

FIG. 19 is a cross-sectional view of an exemplary first/second frame structure in accordance with some embodiments of the present subject matter. FIG. 20 is a cross-sectional view of another exemplary first second frame structure in accordance with some embodiments of the present subject matter. With reference to FIG. 19, a cross-sectional view of an installed multipurpose cantilever skidding frame 103 along the first or second frame structure 301, 302 is illustrated before exemplary wedges are installed. With reference to FIG. 20, a cross-sectional view of an installed multipurpose cantilever skidding frame 103 along the first or second frame structure 301, 302 is illustrated after the wedges 321 are installed. Upon installation of cantilever 103, exemplary longitudinal skidding driving mechanisms 135 (see FIG. 2) may then be installed. Other components of the system (e.g., drag chains, material or mud lines, cutting return lines, and the like) can be installed once appropriate components or equipment within the cantilever 104 are ready to accept respective fittings, etc.

Figure 21:
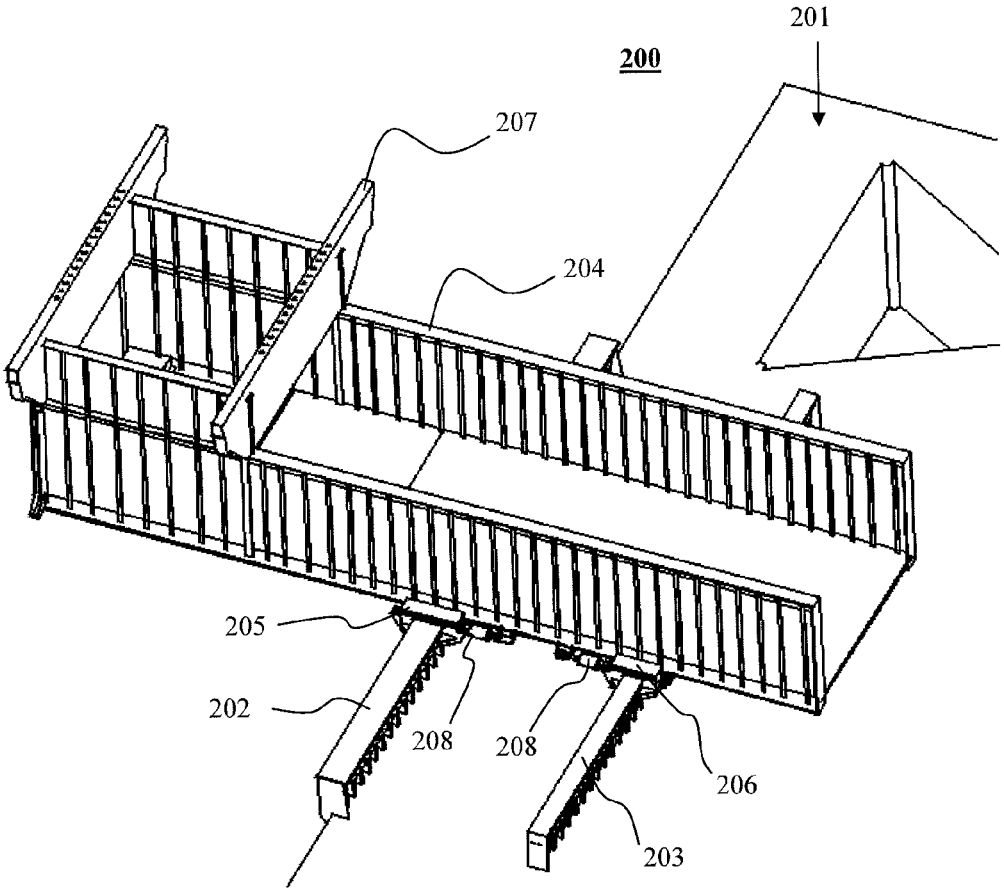
FIG. 21 is an isometric view of a drilling unit employing a multi-direction direct cantilever skidding system in accordance with some embodiments of the present subject matter.

FIG. 21 is an isometric view of a drilling unit employing a multi-direction direct cantilever skidding system in accordance with some embodiments of the present subject matter. With reference to FIG. 21, another exemplary embodiment of a Jackup drilling rig, unit 200 or other mobile platform is illustrated having a first (e.g., aft) transverse skidding rail 202 and a second (e.g., forward) transverse skidding rail 203 affixed to the top of a rig platform 201. The drilling rig or unit 200 includes a cantilever 204 disposed on the skidding rails 202, 203 and may also include a multi-direction direct cantilever skidding system as described above. Disposed on the cantilever 204 may be a drilling floor 207. While the first (aft) and second (forward) transverse skidding rails 202, 203 have been associated with a specific frame of reference, the claims appended herewith should not be so limited as the cantilever 204 may extend from any portion of the rig platform 201 including the aft, beams and forward portion of the rig platform 201. As illustrated, the aft and forward transverse skidding rails 202, 203 may be affixed onto a Jackup deck or rig platform 201 and configured in parallel to provide direct support for the cantilever 204. During operation of the system, the aft transverse skidding rail 202 directly supports the load of the cantilever 204 at all times and may thus be required to carry large downward vertical loads when the cantilever 204 is extended. In such an embodiment, the forward transverse skidding rail 203 may also directly support the cantilever 204 but may be required to carry large downward vertical loads upon retraction of the cantilever 204. Thus, in one non-limiting embodiment, an exemplary aft transverse skidding rail 202 may be wider and/or more heavily reinforced than the forward transverse skidding rail 203. In another embodiment, both transverse skidding rails 202, 203 have substantially equal dimensions and respective reinforcements. It should be noted that when the cantilever 204 is in an extended position, the forward transverse skidding rail 203 may be required to carry large upward vertical loads, i.e., hold down forces. Thus, due to differences in load carrying requirements, some embodiments of the present subject matter may include aft and forward transverse skidding rails 202, 203 with different cross section designs. Of course, other embodiments of the present subject matter may include aft and forward transverse skidding rails 202, 203 with similar or identical configurations or cross sections. In some embodiments, skidding pads may be added to the aft and forward transverse skidding rails 202, 203 to enable smooth skidding of the cantilever 204 thereon and to reduce friction between the cantilever 204 and the skidding rails 202, 203. Exemplary skidding pads may be provided with various profiles to enhance skidding and may be constructed of lower friction materials such as bronze. In alternative embodiments of the present subject matter, the skidding pads may be provided on the lower flange of the cantilever beams and/or applied to both the cantilever and the transverse skidding rails.

Figure 22:
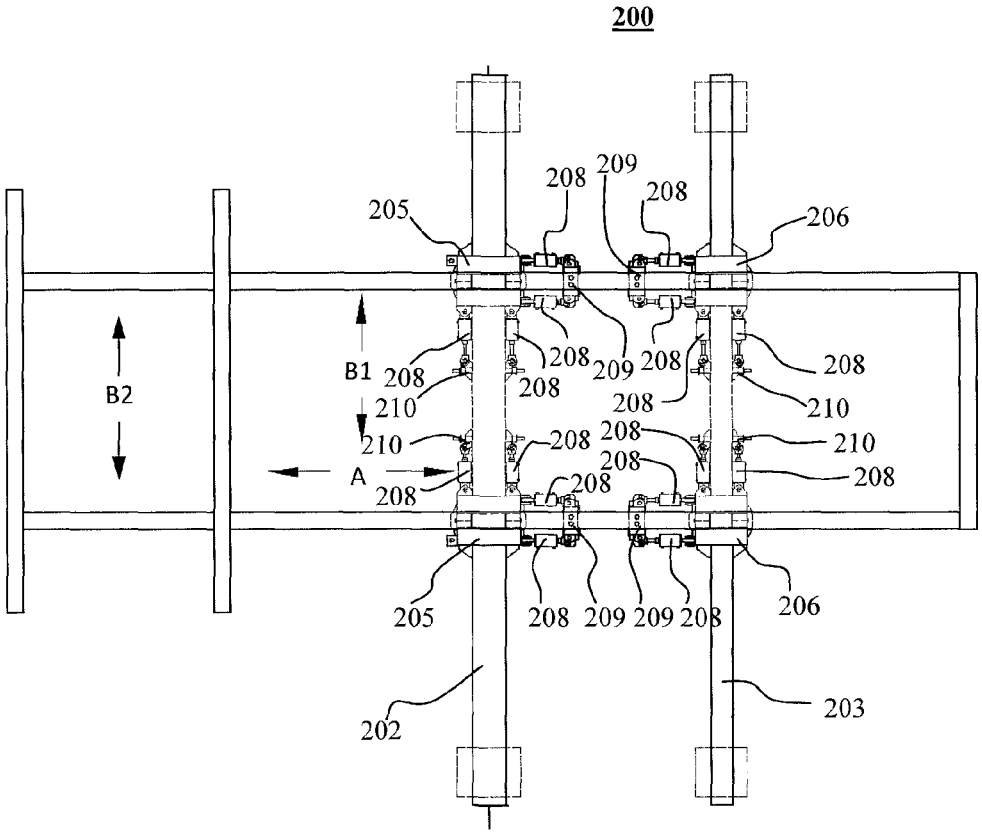
FIG. 22 is a top plan view of the drilling unit of FIG. 21.

FIG. 22 is a top plan view of the drilling unit of FIG. 21. With reference to FIG. 22 and continued reference to FIG. 21, another embodiment of a multi-direction direct cantilever skidding system may include a one or more aft guides 205 disposed on the aft transverse skidding rail 202 and one or more forward hold down guides 206 disposed on the forward transverse skidding rail 203. In the depicted embodiment, two aft guides 205 and forward hold down guides 206 are illustrated. The exemplary system may also include a plurality of skid driving mechanisms 208. Exemplary skid driving mechanisms 208 include, but are not limited to, hydraulic skidding cylinders, rotary skidding mechanisms, electric skidding mechanisms, and other suitable drive mechanisms utilized in the industry. The system may include a plurality of longitudinal skidding supports 209 slidably attached on the cantilever 204 and a plurality of transverse skidding supports 210 slidably attached on the transverse skidding rails 202, 203. In some embodiments, the skid driving mechanisms 208 may be coupled at one end thereof with the aft guides 205 and/or forward hold down guides 206. The skid driving mechanisms 208 may also be coupled at an opposing end thereof to the longitudinal and/or transverse skidding supports 209, 210. In some embodiments, each aft guide 205 and/or forward hold down guide 206 may be coupled with any number of skid driving mechanisms 208. In the depicted, non-limiting embodiment, each guide is coupled to four skid driving mechanisms 208 where two of the skid driving mechanisms 208 are coupled to the longitudinal skidding support 209 for moving the cantilever 204 in the longitudinal direction and two skid driving mechanisms 208 are coupled to the transverse skidding supports 210 for moving the cantilever 204 in the transverse direction. Thus, utilizing embodiments of the present subject matter drill well locations may be reached by a combination of cantilever movement in both a longitudinal direction "A" and a transverse direction "B1" along the skidding rails 202, 203. Additional embodiments of the present subject matter provide a further transverse movement "B2" through the slidable coupling of the drill floor 207 to the cantilever 204. This second transverse movement B2 allows an expansion of reach for exemplary drill well locations and may provide movement between proximate wells without transverse skidding of the entire cantilever 204.

Figure 23:
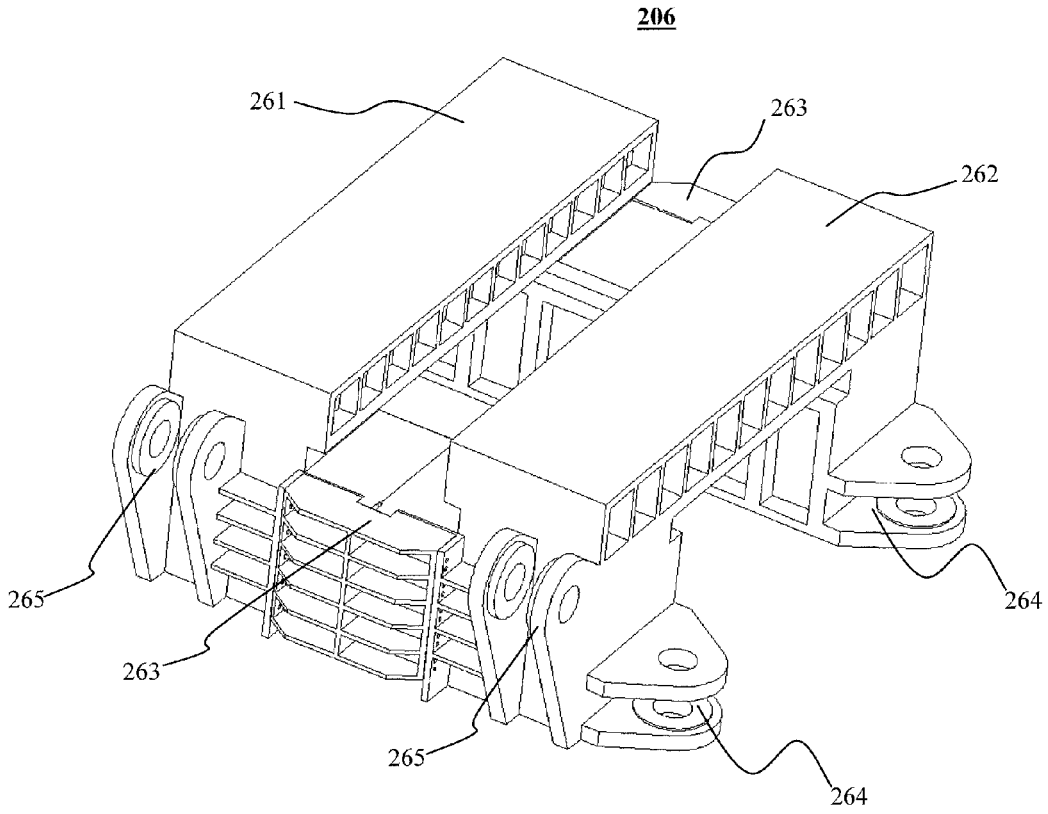
FIG. 23 is an isometric view of a forward hold down guide in accordance with some embodiments of the present subject matter.
Figure 24:
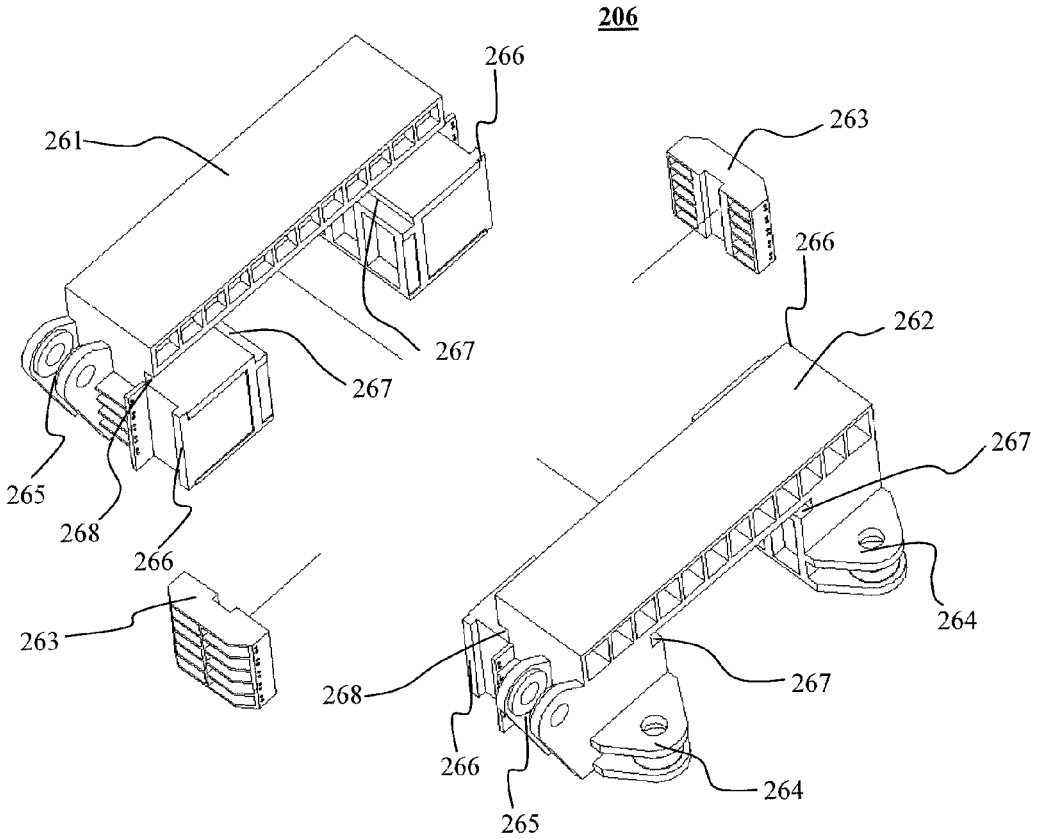
FIG. 24 is an exploded view of the forward hold down guide of FIG. 23.

FIG. 23 is an isometric view of a forward hold down guide in accordance with some embodiments of the present subject matter. FIG. 24 is an exploded view of the forward hold down guide of FIG. 23. With reference to FIGS. 23 and 24, an exemplary forward hold down guide 206 may include an outer fixture or portion 261 located external the cantilever 204 and an inner fixture or portion 262 located proximate and below the cantilever 204. The forward hold down guide 206 may also include one or more locking mechanisms 263 for locking the two ends of outer and inner fixtures 261, 262 upon assembly thereof. In a non-limiting embodiment, the outer and inner fixtures 261, 262 of an exemplary forward hold down guide 206 may be shaped in a saddle configuration (e.g., U-shaped) so the outer and inner fixtures 261, 262 may be slidably disposed on a respective skidding rail 203. Of course, other geometric configurations are envisioned for exemplary embodiments and such an example should not limit the scope of the claims appended herewith. In some embodiments, the outer fixture 261 may be configured with a longitudinal coupling structure 265 at one end for coupling to an exemplary skid driving mechanism 208 (not shown) thereby allowing for longitudinal movement of the cantilever 204. These longitudinal coupling structures 265 may be provided on any sides of the inner and/or outer fixtures 262, 261 and the specific depiction thereof in FIGS. 23 and 24 should not limit the scope of the claims appended herewith. The outer fixture 261 may also include an extension member 266 at one or both ends thereof to enable a locking mechanism 263 to secure the outer and inner fixtures 261, 262 upon assembly. Exemplary locking mechanisms 263 may be clamps or the like to provide a rigid connection of the outer and inner fixtures 261, 262. Further, in certain embodiment, the various locking mechanisms 263 utilized in an exemplary hold down guide 206 may be identical or different on opposing parts of the respective guide 206. As illustrated in FIG. 23, the locking mechanisms 263 may wrap around extension members 266 provided on the outer and inner fixtures 261, 262 and may be joined and secured in place using, for example, bolts, welds, and the like. In an alternative embodiment, connection of the outer and inner fixtures 261, 262 may be performed through the use of bolts, other clamps, interlocking arrangements, or a combination thereof.

A transverse or lower claw 267 at both ends of the outer fixture 261 may be formed where the outer fixture 261 directly interfaces with the top edges of a rail (not shown) to enable an exemplary hold down guide 206 to wrap around the top edges of the rail. A longitudinal or upper claw 268 may also be formed where the outer fixture 261 directly interfaces with the bottom edges of a cantilever beam (not shown) to enable an exemplary hold down guide 206 to wrap around the bottom edges of the beam. In some embodiments, the inner fixture 262 may provide a configuration substantially similar to that of the outer fixture 261. In other embodiments, the inner fixture 262 may also include two transverse coupling structures 264 to provide a coupling mechanism for a respective skid driving mechanism 208 (not shown) and thus allow for transverse movement of the cantilever 204. These transverse coupling structures 264 may be provided on any sides of the inner and/or outer fixtures 262, 261 and the specific depiction thereof in FIGS. 23 and 24 should not limit the scope of the claims appended herewith. Upon installation of an exemplary hold down guide 206, the outer and inner fixtures 262, 261 may wrap around the edges of a transverse skidding rail as a function of the transverse claw and may wrap around the edges of a cantilever beam as a function of the longitudinal claw. Thus, this interface of the forward hold down guide 206 with the transverse rails and cantilever beam may provide adequate hold down forces for embodiments of the present subject matter. Exemplary aft guides 205 may also be constructed in similar fashion to the forward hold down guide 206. In some embodiments, the aft guide 205 and forward hold down guide 206 may have different dimensions due to the difference in the respective loading.

Figure 25:
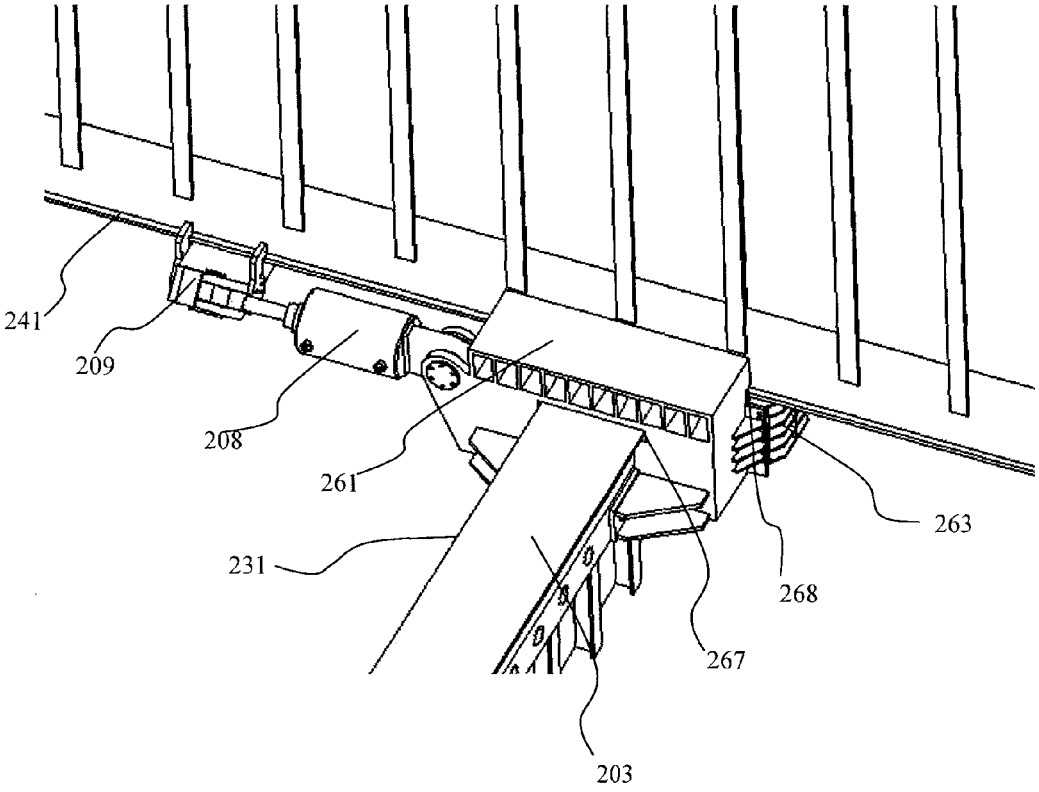
FIG. 25 is an isometric view of a portion of the drilling unit of FIG. 21.

FIG. 25 is an isometric view of a portion of the drilling unit of FIG. 21. With reference to FIG. 25, upon installation of a forward hold down guide 206, the transverse or lower claw 267 provided on the outer and inner fixtures 261, 262 may wrap around the edges 231 of the transverse skidding rail 203 as illustrated. Further, as noted above, the upper or longitudinal claw 268 provided on the outer and inner fixtures 261, 262 may wrap around the edges 241 of the cantilever beam. While the claws are illustrated as having a C-shaped geometry, additional geometries or arrangements are also envisions that may wrap around the edges of respective rails or beams in similar fashion and the claims appended herewith should not be so limited. As illustrated the upper or longitudinal claw 268 is provided in an inverse arrangement with respect to the lower or transverse claw 267 as related to the respective beam or rail. In some embodiments of the present subject matter, these two claws 267, 268 provide ample hold down forces and transference thereof for exemplary systems when the cantilever 204 is in an extended position.

It may be noted that the aft guides 205 on the aft transverse skidding rail 202 may be, depending upon the position of an exemplary system, located at the stem of a drilling unit and may not be subject to significant hold down forces during operation. Thus, in some embodiments exemplary aft guides 205 may incorporate a design for primarily transferring horizontal skidding forces and holding a cantilever against horizontal loads. Conversely, forward hold down guides 206 on the forward transverse skidding rail 203 may be required to provide significant hold down forces and may also be employed for transference of horizontal skidding forces and holding of the cantilever against horizontal load. Thus, it is envisioned in some embodiments that the aft and forward guides 205, 206 may possess different designs with or without differing dimensions for the stem and forward rails. For example, in one embodiment the aft guides 205 may not need claws 267, 268 as the need for hold down forces is not present. Of course, in certain embodiments, the aft and forward guides 205, 206 and the respective rails may all have the same or substantially similar design.

Figure 26A:
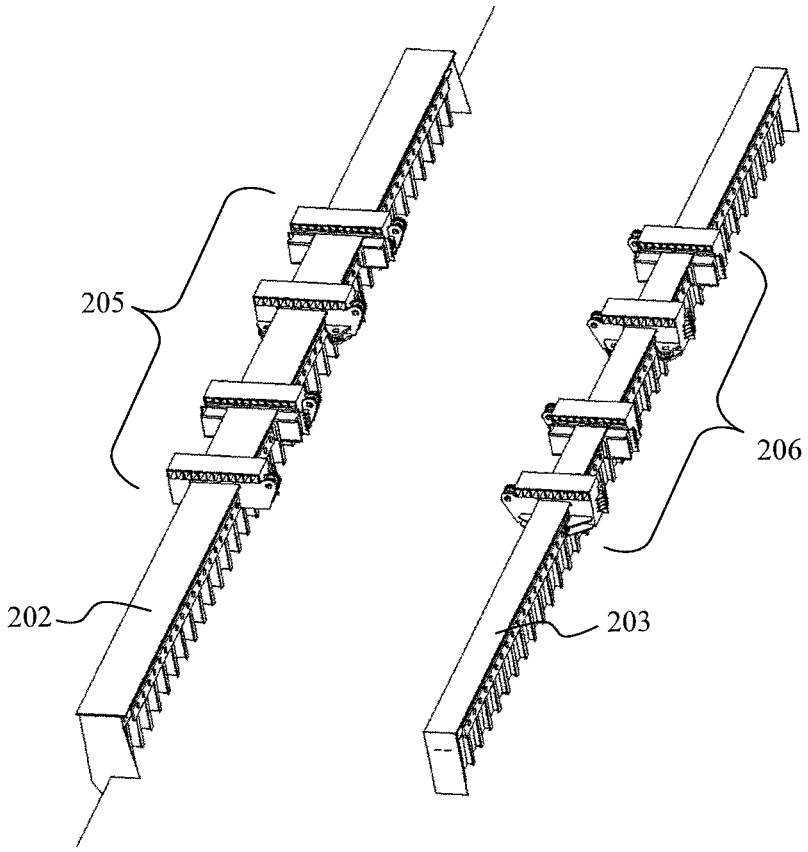
FIGS. 26A-26C are isometric views of the drilling unit of FIG. 21 providing an illustrative installation process.
Figure 26B:
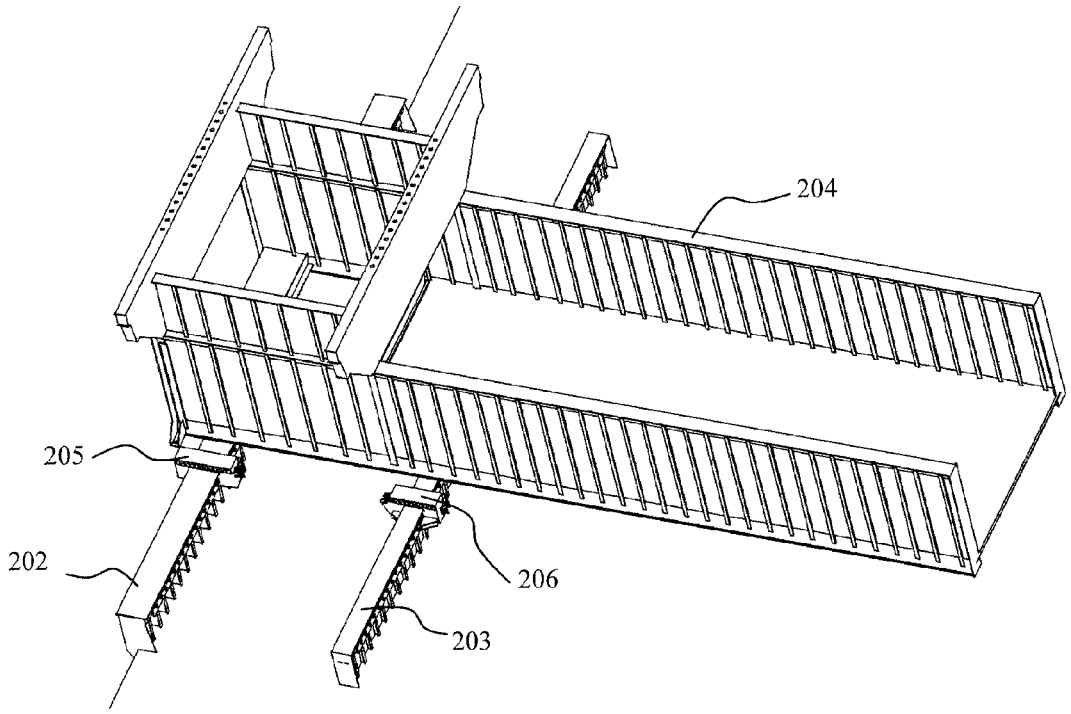
Figure 26C:
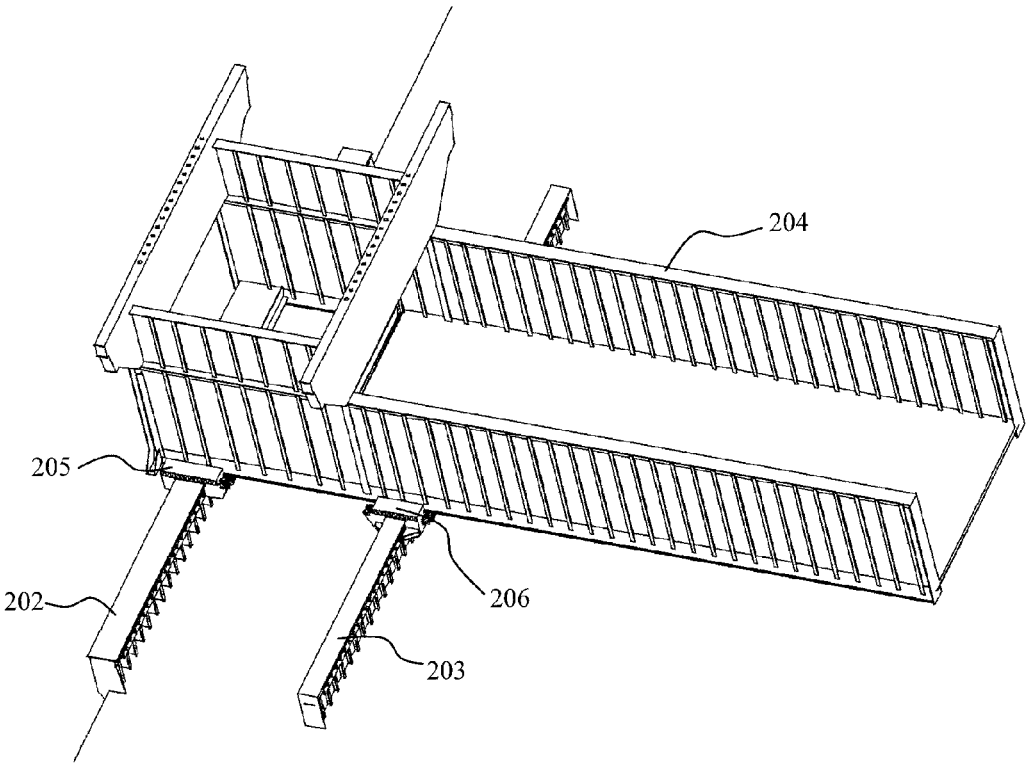

FIGS. 26A-26C are isometric views of the drilling unit of FIG. 21 providing an illustrative installation process of a multi-direction direct cantilever skidding system in an exemplary drilling unit. As illustrated in FIG. 26A, aft and forward guides 205, 206 may be installed on the aft and forward transverse skidding rails 202, 203. Any number of aft and forward guides may be utilized in embodiments of the present subject matter. In the depicted, non-limiting embodiment two aft guides 205 (comprising two halves or outer/inner fixtures) may be disposed on the aft transverse skidding rail 202 and two forward hold down guides 206 (comprising two halves or outer/inner fixtures) may be disposed on the forward transverse skidding rail 203. In some embodiments, these guides 206 may be installed by sliding onto the end(s) of the respective transverse rail. In other embodiments, the guides may be assembled directly on the respective transverse rail. As illustrated in FIG. 26B, an exemplary cantilever 204 may be installed upon the aft and forward transverse skidding rails 202, 203. For example, the cantilever 204 may be lifted by a crane or other mechanism (not shown) to align and place the cantilever 204 on the transverse skidding rails 202, 203 to ensure that half of the guide claws are located on each side of the beams of the cantilever 204 and to ensure that the cantilever center of gravity is located between the transverse rails 202, 203 thereby providing balanced support for the cantilever 204. As illustrated in FIG. 26C, the two halves of the respective guides 205, 206 may then be connected together using suitable connecting mechanisms discussed above (e.g., bolts, clamps 263, and the like) to create a single guide slidably wrapping around the flanges or edges of the a respective cantilever beam and transverse skidding rail.

Figure 27:
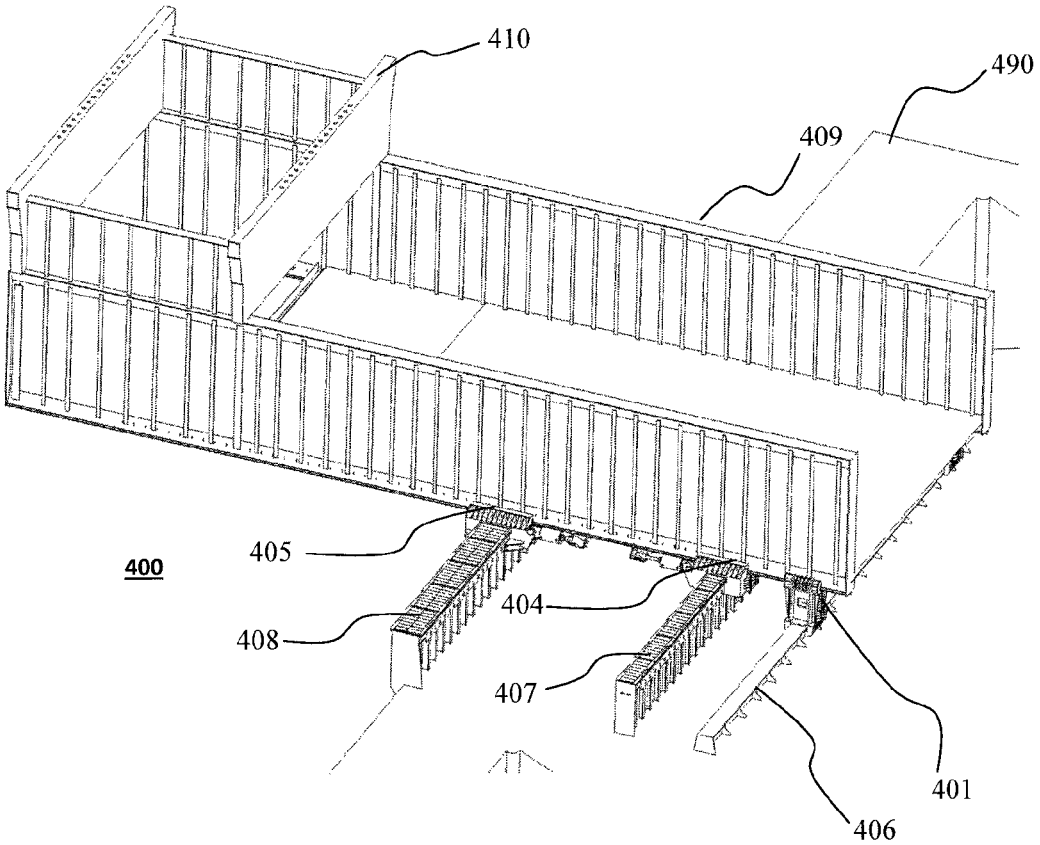
FIG. 27 is an isometric view of another drilling unit employing a three-rail multi-direction direct cantilever skidding system in accordance with some embodiments of the present subject matter.

FIG. 27 is an isometric view of another drilling unit employing a three-rail multi-direction direct cantilever skidding system in accordance with some embodiments of the present subject matter. With reference to FIG. 27, a drilling rig or unit 400 is illustrated having a rig platform 490 with a forward hold down rail 406, a forward transverse skidding rail 407, and an aft transverse skidding rail 408 suitably affixed to the platform 490. A forward hold down guide 401, forward cantilever skidding guide 404, and aft cantilever skidding guide 405 may be provided for slidably securing an exemplary cantilever 409 to the rails 406, 407, 408. For example, the forward hold down guide 401 may be slidably disposed on the forward hold down rail 406, the forward cantilever skidding guide 404 may be slidably disposed on the forward transverse skidding rail 407, and the aft cantilever skidding guide 405 may be slidably disposed on the aft transverse skidding rail 408. Further, the cantilever 409 may be slidably engaged with the upper claws of the cantilever hold down guide 401 while the loading of the cantilever 409 is supported by the skidding rails 407, 408. A drilling floor or unit 410 may be affixed or slidably disposed on the cantilever 409. Exemplary rails 406, 407, 408 may be formed of suitable materials (e.g., steel, iron, and other metals and alloy) and affixed to the platform 490. While the forward and aft skidding guides 404, 405 may be any suitable guide, exemplary skidding guides described above may be employed in an exemplary drilling rig 400 described herein.

Figure 28A:
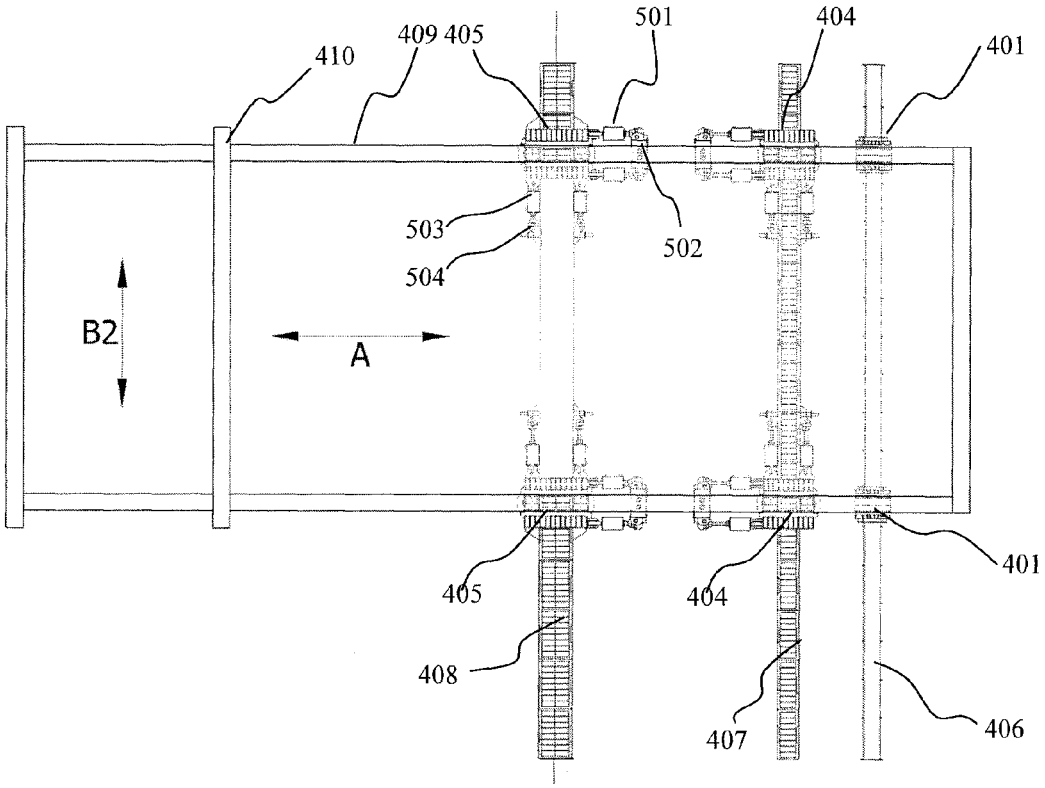
FIG. 28A is a top plan view of the drilling unit of FIG. 27 in an extended position.

FIG. 28A is a top plan view of the drilling unit of FIG. 27 in an extended position. With reference to FIG. 28A, an exemplary cantilever 409 is illustrated in an extended position as a function of the longitudinal skidding or movement of the cantilever in direction "A" allowed by use of the aft transverse skidding rail 408 to provide support of cantilever loading and by employing the forward hold down guide 401 to provide necessary hold down forces on the forward hold down rail 406. In some embodiments, an exemplary aft skidding rail 408 may also provide support for the aft skidding guide 405 which, in turn, may provide appropriate coupling to an exemplary skid driving mechanism(s). The forward transverse skidding rail 407 may also provide loading support for the cantilever 409 when the cantilever center of gravity is retracted to a position forward of the aft skidding rail 408. In additional embodiments, the forward transverse skidding rail 407 may also provide support for the forward skidding guide 404 which, in turn, may provide appropriate coupling to an exemplary longitudinal skid driving mechanism(s). As illustrated in FIG. 28A, the cantilever 409 may not (or may) be provided with transverse movement; however, it is envisioned that transverse movement of the drill floor 410 in direction "B2" may be employed to access side wells without retracting an extended cantilever 409. Movement of the cantilever 409 in a longitudinal direction "A" may be accomplished by utilization of skid driving mechanisms 501 coupled on one end with coupling structures in exemplary cantilever skidding guides 404, 405 and on an opposing end with longitudinal skidding supports 502 to drive the cantilever 409 in a longitudinal direction.

Figure 28B:
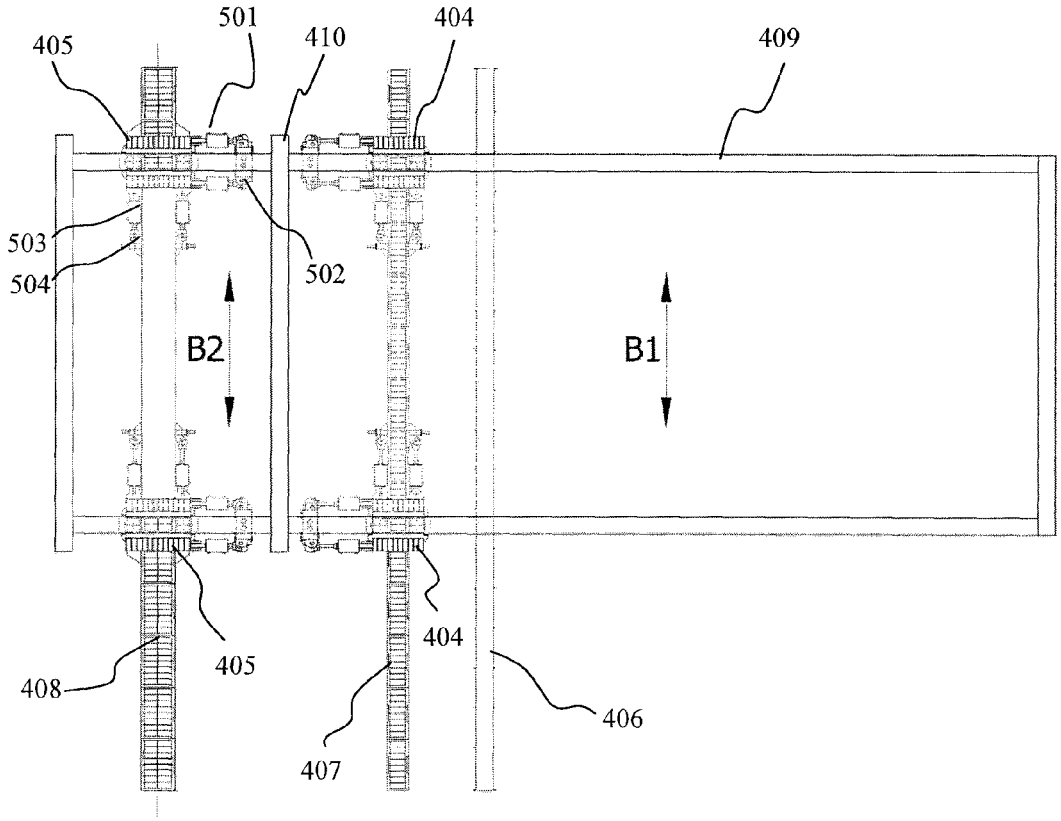
FIG. 28B is a top plan view of the drilling unit of FIG. 27 in a retracted position.

FIG. 28B is a top plan view of the drilling unit of FIG. 27 in a retracted position. It is to be appreciated that this may not be a fully retracted position, but rather a position where by the center of gravity is moved to act between the forward and aft skidding rails. With reference to FIG. 28B, transverse movement or skidding of a cantilever 409 in a transverse direction "B1" may be allowed by use of the aft skidding rail 408 and forward skidding rail 407 to provide loading support of the cantilever 409. In such an embodiment, the cantilever 409 is in a retracted position. During such an operation, the forward hold down guide 401 may generally be in an unloaded state, and as such is not shown in FIG. 28B for the sake of clarity. In addition to transverse movement of the cantilever 409, transverse movement of the drill floor 410 in a transverse direction "B2" may also be employed. Transverse cantilever skidding may be performed by exemplary skid driving mechanisms 503 coupled on one end with exemplary coupling structures in respective cantilever skidding guides 404, 405 and on an opposing end with transverse skidding supports 504 to drive the cantilever 409 in a transverse direction.

Figure 29A:
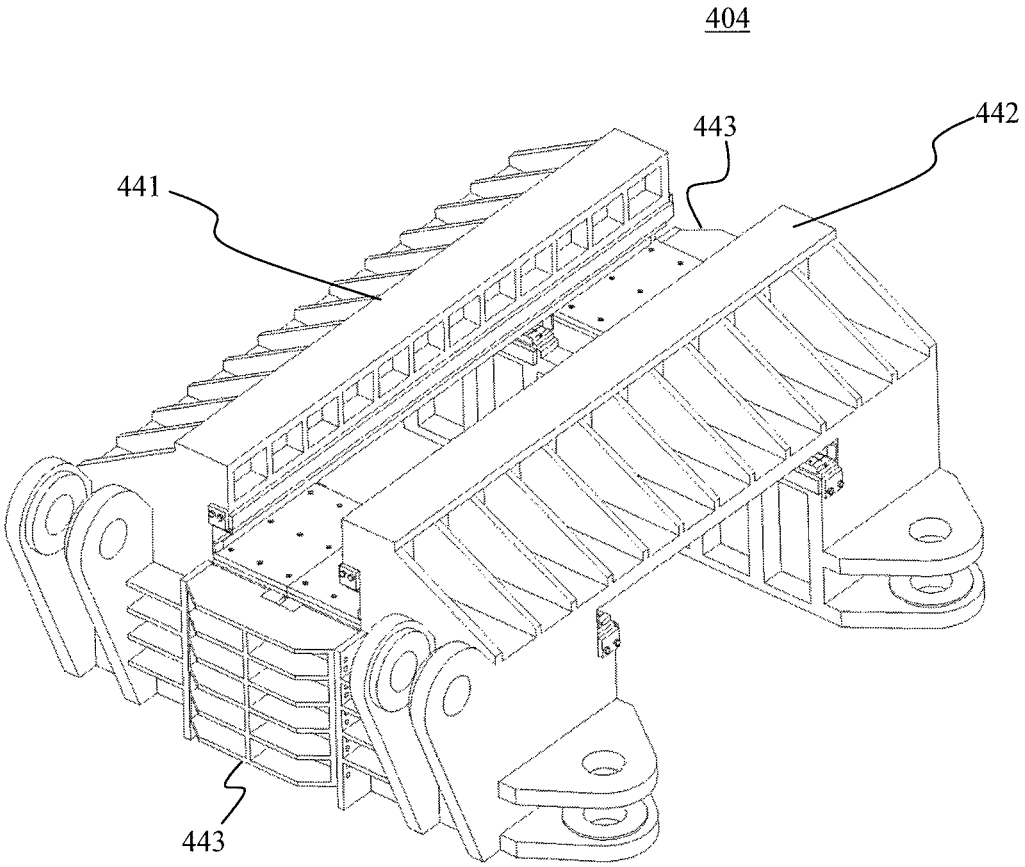
FIG. 29A is an isometric view of a forward cantilever skidding guide in accordance with some embodiments of the present subject matter.
Figure 29B:
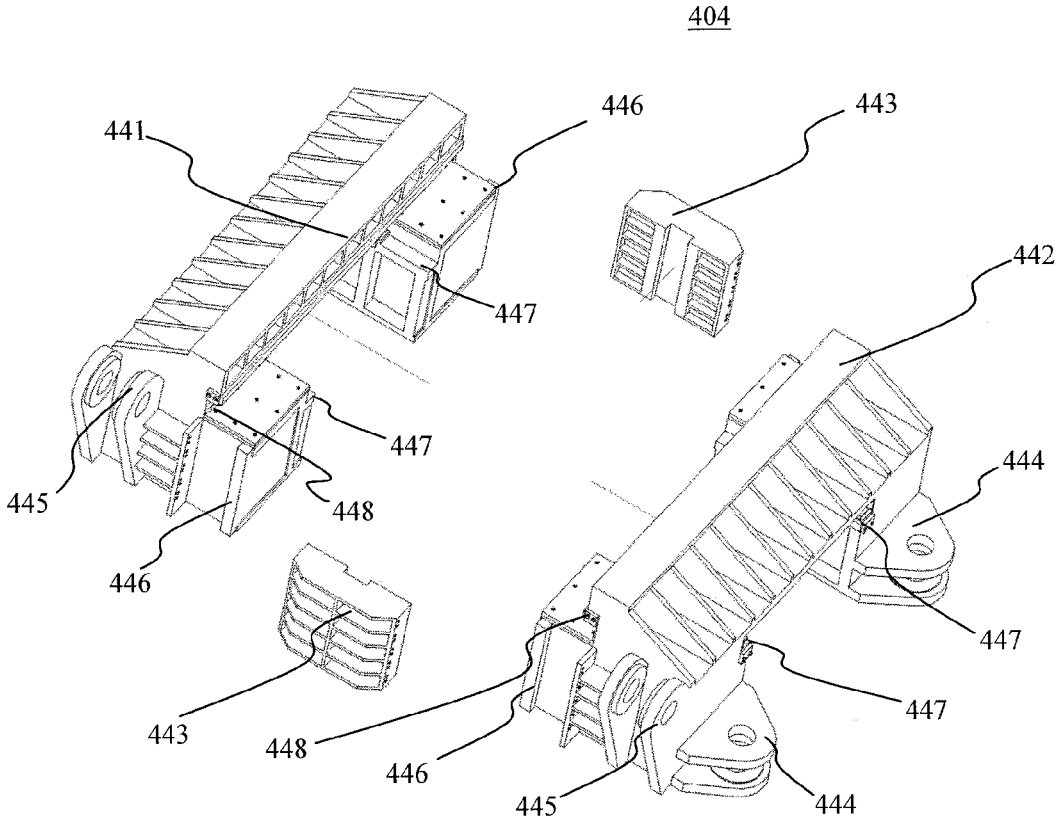
FIG. 29B is an exploded isometric view of the forward cantilever skidding guide of FIG. 29A.
Figure 31:
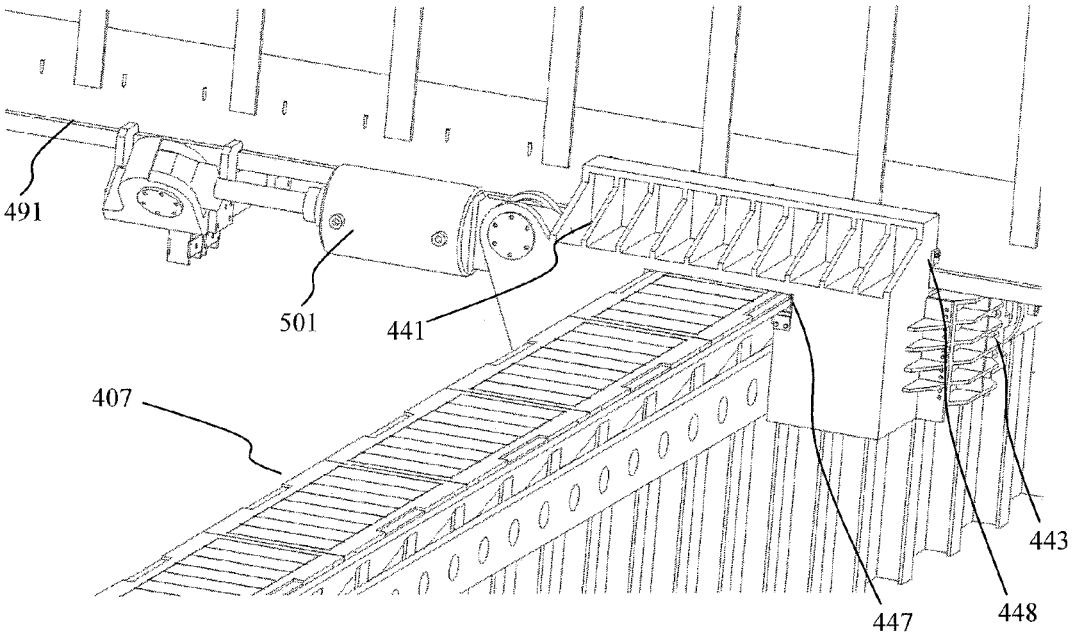
FIG. 31 is an isometric view of a forward cantilever skidding guide in accordance with some embodiments of the present subject matter.

FIG. 29A is an isometric view of a forward cantilever skidding guide in accordance with some embodiments of the present subject matter. FIG. 29B is an exploded isometric view of the forward cantilever skidding guide of FIG. 29A. FIG. 31 is an isometric view of a forward cantilever skidding guide in accordance with some embodiments of the present subject matter. With reference to FIGS. 29A, 28B and 31, an exemplary forward cantilever skidding guide 404 may include an outer fixture or portion 441 located external the cantilever 409 and an inner fixture or portion 442 located proximate and below the cantilever 409. The forward cantilever skidding guide 404 may also include a plurality of suitable locking mechanisms 443 for locking the two ends of the outer and inner fixtures 441, 442 upon assembly thereof and securing these fixtures into a rigid structure. When the outer and inner fixtures 441, 442 are assembled, the configuration may provide a slot to accommodate a proximate beam 491 of an overlying cantilever while any cantilever loading is substantially supported by the forward transverse skidding rail 407. The outer and inner fixtures 441, 442 may be slidably disposed on the forward transverse skidding rail 407 and can be moved in a transverse direction thereon. An exemplary inner fixture 442 may include a coupling structure 444 for coupling with a transverse skid driving mechanism 503 and a coupling structure 445 for coupling with a longitudinal skid driving mechanism 501. The inner fixture 442 may also include a lower slot 447 for accommodating the forward transverse skidding rail 407 and an upper slot 448 for accommodating a proximate beam of an overlying cantilever. In some embodiments, the outer fixture 441 may be substantially similar in form to the inner fixture 442. In other embodiments, the outer fixture 441 may not include coupling structures for coupling with transverse skidding mechanisms. In alternative embodiments, any one or both of the inner and outer fixtures may include coupling structures for transverse skid driving mechanisms. In the depicted non-limited embodiment, the outer and inner fixtures 441, 442 may include end flanges 446 whereby, upon assembly, suitable locking mechanisms 443 may be employed to secure or affix the outer and inner fixtures 441, 442. In some embodiments, exemplary aft skidding guides 405 may be substantially similar in form to the forward skidding guides 404. In other embodiments, due to any differences in the size of the forward and aft transverse skidding rails, there may be some differences in the dimensions and/or details of the forward and aft skidding guides 404, 405.

Figure 30A:
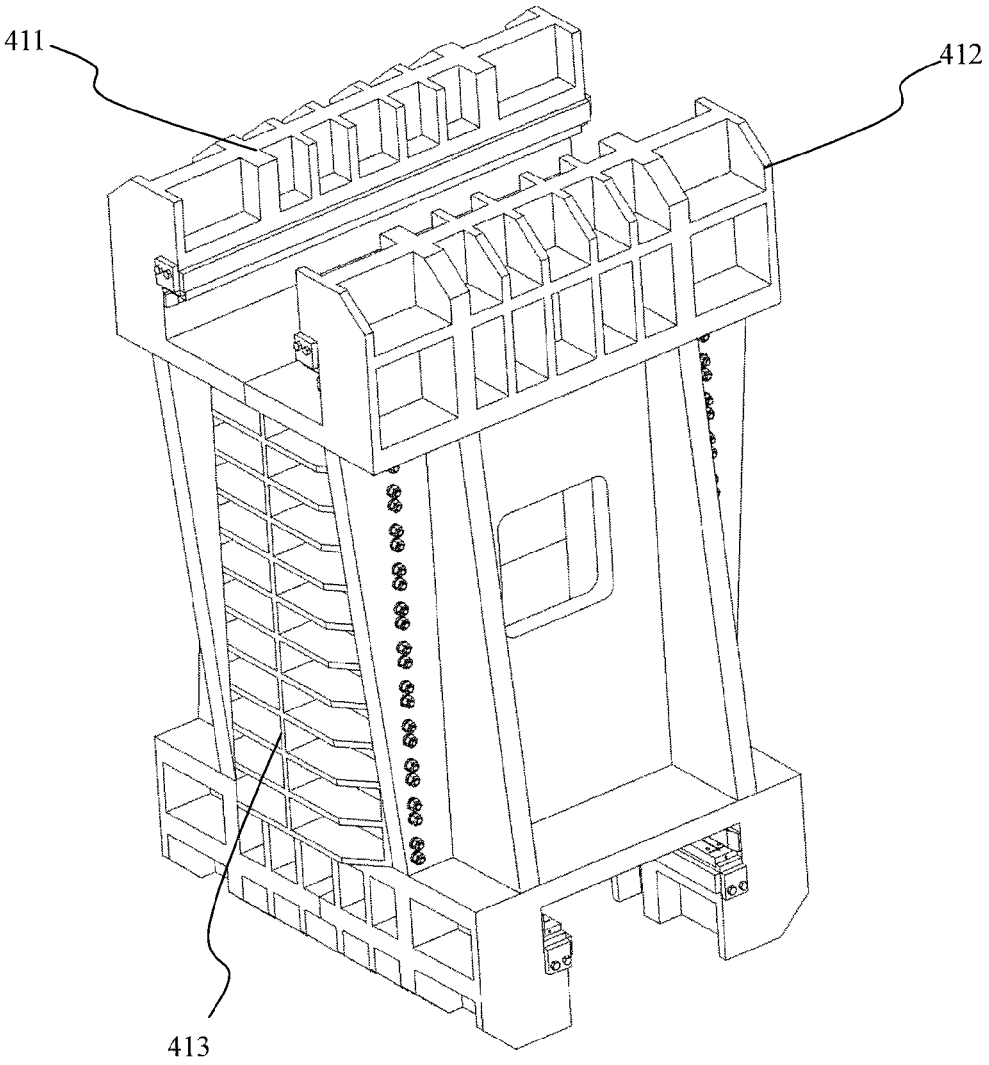
FIG. 30A is an isometric view of a forward hold down guide in accordance with some embodiments of the present subject matter.
Figure 30B:
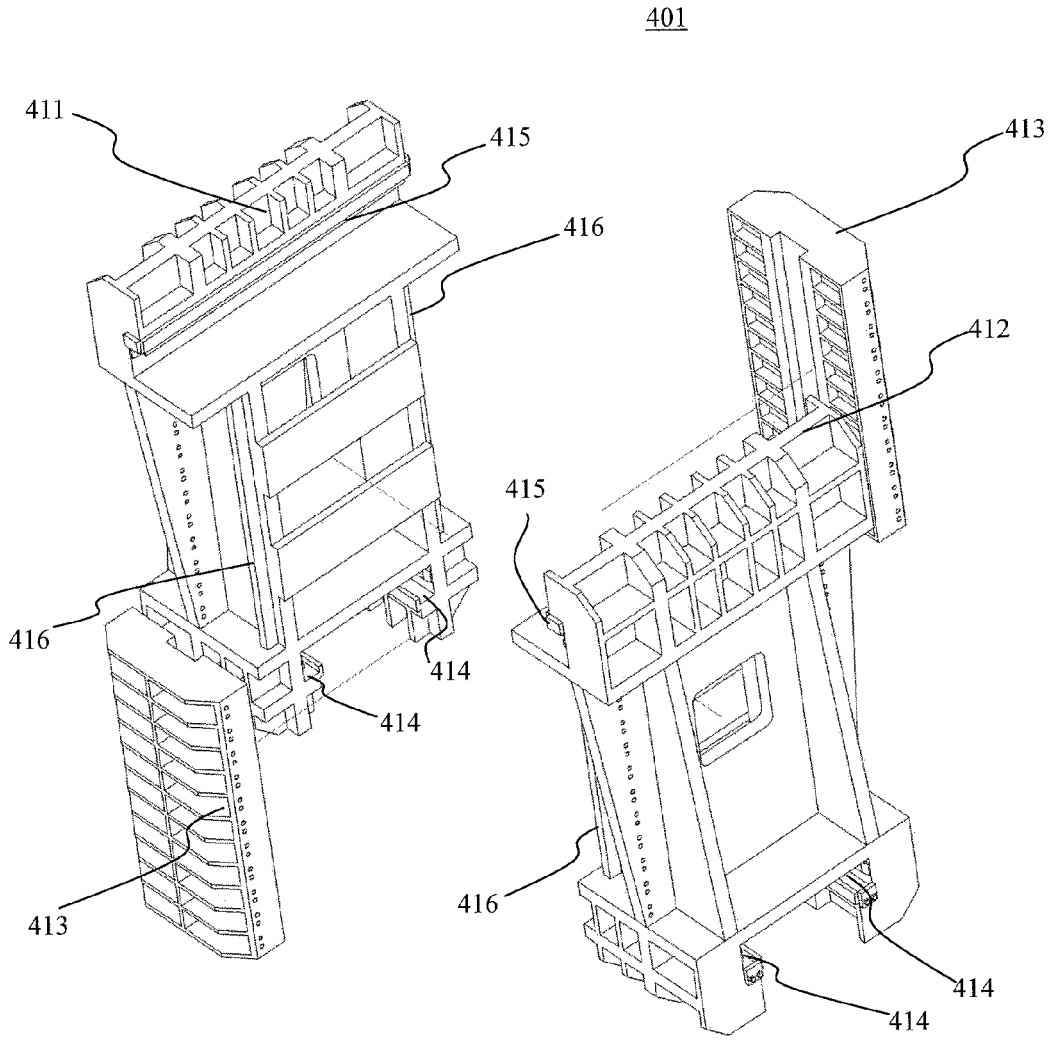
FIG. 30B is an exploded isometric view of the forward hold down guide of FIG. 30A.
Figure 32:
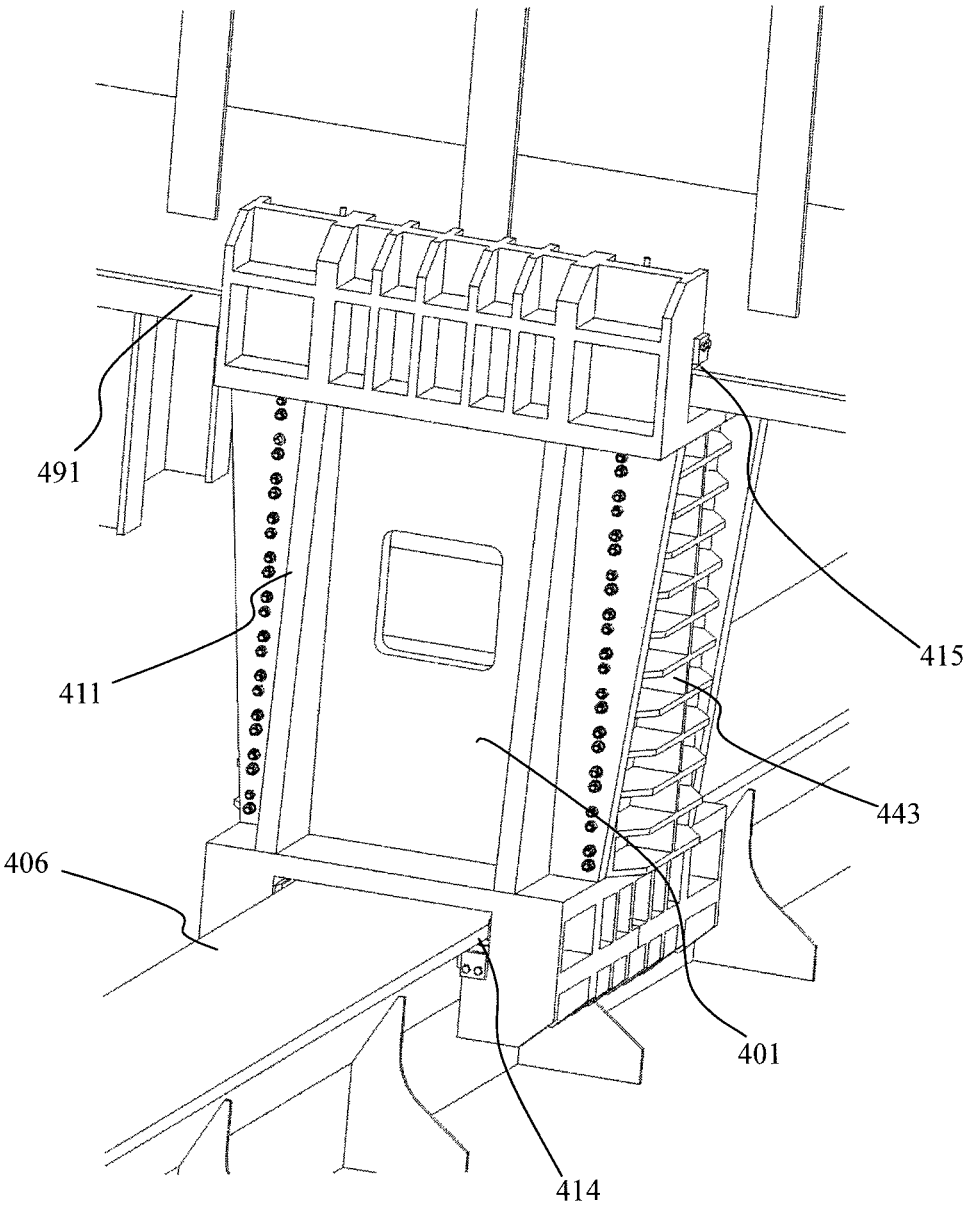
FIG. 32 is an isometric view of a forward hold down guide in accordance with some embodiments of the present subject matter.

FIG. 30A is an isometric view of a forward hold down guide in accordance with some embodiments of the present subject matter. FIG. 30B is an exploded isometric view of the forward hold down guide of FIG. 30A. FIG. 32 is an isometric view of a forward hold down guide in accordance with some embodiments of the present subject matter. With reference to FIGS. 30A, 30B and 32, an exemplary forward hold down guide 401 may include an outer fixture or portion 411 located external the cantilever 409 and an inner fixture or portion 412 located proximate and below the cantilever 409. The forward hold down guide 401 may also include a plurality of locking mechanisms 413 for locking the two ends of the outer and inner fixtures 411, 412 upon assembly thereof and securing these fixtures into a rigid structure. When the outer and inner fixtures 411, 412 are assembled, the configuration may provide a slot to accommodate a proximate beam 491 of an overlying cantilever while any cantilever loading is substantially supported by the forward transverse skidding rail 407. The outer and inner fixtures 411, 412 may be slidably disposed on the forward hold down rail 406 and may be moved in a transverse direction thereon. The inner fixture 412 may also include a lower slot for accommodating the forward hold down rail 406 and an upper slot for accommodating a proximate beam 491 of an overlying cantilever. In some embodiments, the outer fixture 411 may be substantially similar in form to the inner fixture 412. Thus, upon assembly, the outer and inner fixtures 411, 412 may provide a claw 414 to accommodate and wrap under the forward hold down rail 406. In the depicted non-limited embodiment, the outer and inner fixtures 411, 412 may include end flanges 416 whereby, upon assembly, suitable locking mechanisms 413 may be employed to secure or affix the outer and inner fixtures 411, 412 and to form suitable claws 415 to accommodate and wrap around the proximate beam 491 of an exemplary cantilever 409.

Figure 33A:
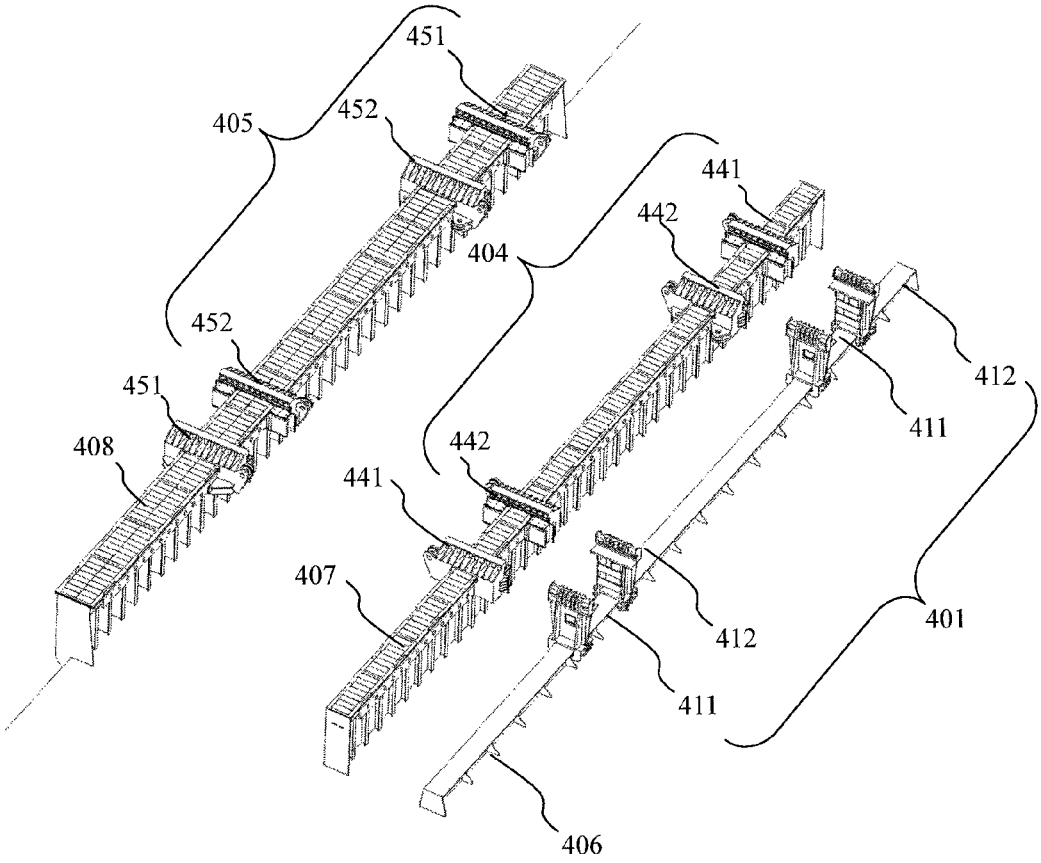
FIGS. 33A-33C are isometric views of the drilling unit of FIG. 27 providing an illustrative installation sequence in accordance with some embodiments of the present subject matter.
Figure 33B:
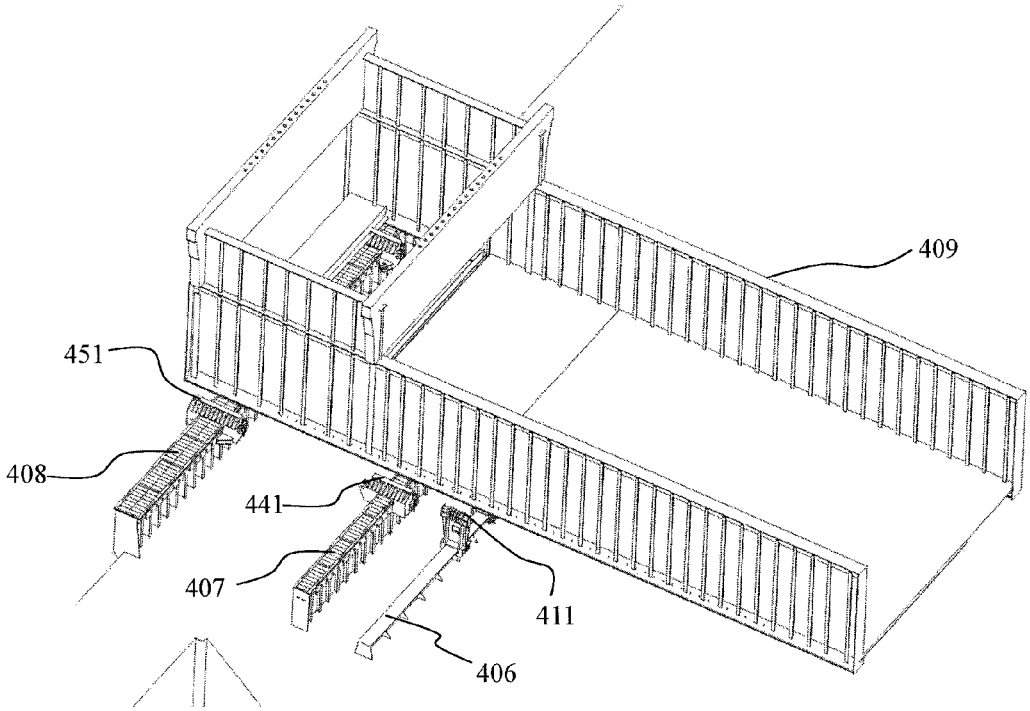
Figure 33C:
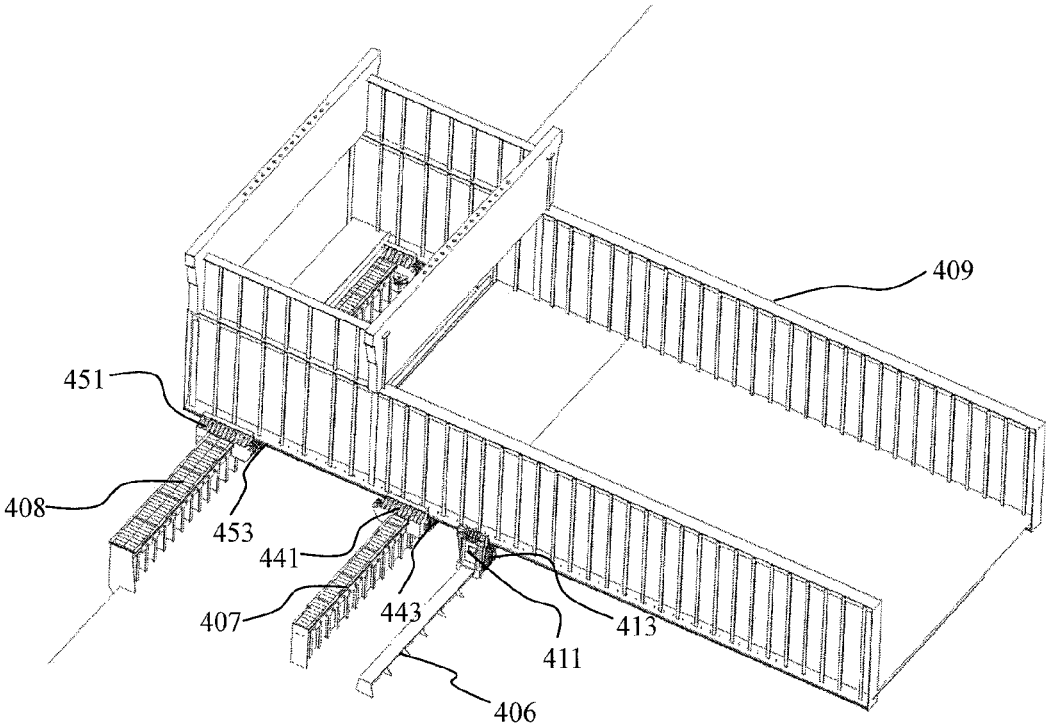

FIGS. 33A-33C are isometric views of the drilling unit of FIG. 27 providing an illustrative installation sequence of an exemplary three-rail multi-direction direct cantilever skidding system in accordance with some embodiments of the present subject matter. As illustrated in FIG. 33A, aft and forward cantilever skidding guides 405, 404 may be slidably installed on the aft and forward transverse skidding rails 408, 407. The forward hold down guides 401 may also be slidably installed on the forward hold down rail 406. Any number of aft and forward guides and hold down guides may be utilized in embodiments of the present subject matter. In the depicted, non-limiting embodiment two aft guides 405 (comprising two halves or outer/inner fixtures 451, 452) may be disposed on the aft transverse skidding rail 408 and two forward cantilever skidding guides 404 (comprising two halves or outer/inner fixtures 441, 442) may be disposed on the forward transverse skidding rail 407. Additionally, two forward hold down guides 401 (comprising two halves or outer/inner fixtures 411, 412) may disposed on the forward hold down rail 406. In some embodiments, these guides may be installed by sliding onto the end(s) of the respective rails. In other embodiments, the guides may be assembled directly on the respective rails. As illustrated in FIG. 33B, an exemplary cantilever 409 may be installed upon the aft and forward transverse skidding rails 408, 407 and above the forward hold down rail 406. For example, the cantilever 409 may be lifted by a crane or other mechanism (not shown) to align and place the cantilever 409 on the skidding rails 407,408 and above the hold down rail 406 to ensure that half of the guide and hold down claws are located on each side of the beams of the cantilever 409 and to ensure that the cantilever center of gravity is located between the skidding rails 407, 408 thereby providing balanced direct support for the cantilever 409. As illustrated in FIG. 33C, the two halves of the respective guides 401, 404, 405 may then be connected together using suitable connecting mechanisms discussed above (e.g., bolts, clamps, and the like) to create a single guide slidably wrapping around the flanges or edges of the a respective cantilever beam and skidding or hold down rail. It should be noted that the drilling unit 410 is depicted as being installed with the cantilever in FIGS. 33B and 33C; however, in other embodiments, the cantilever 409 may be installed first followed by installation of an exemplary drilling unit 410.

Figure 34A:
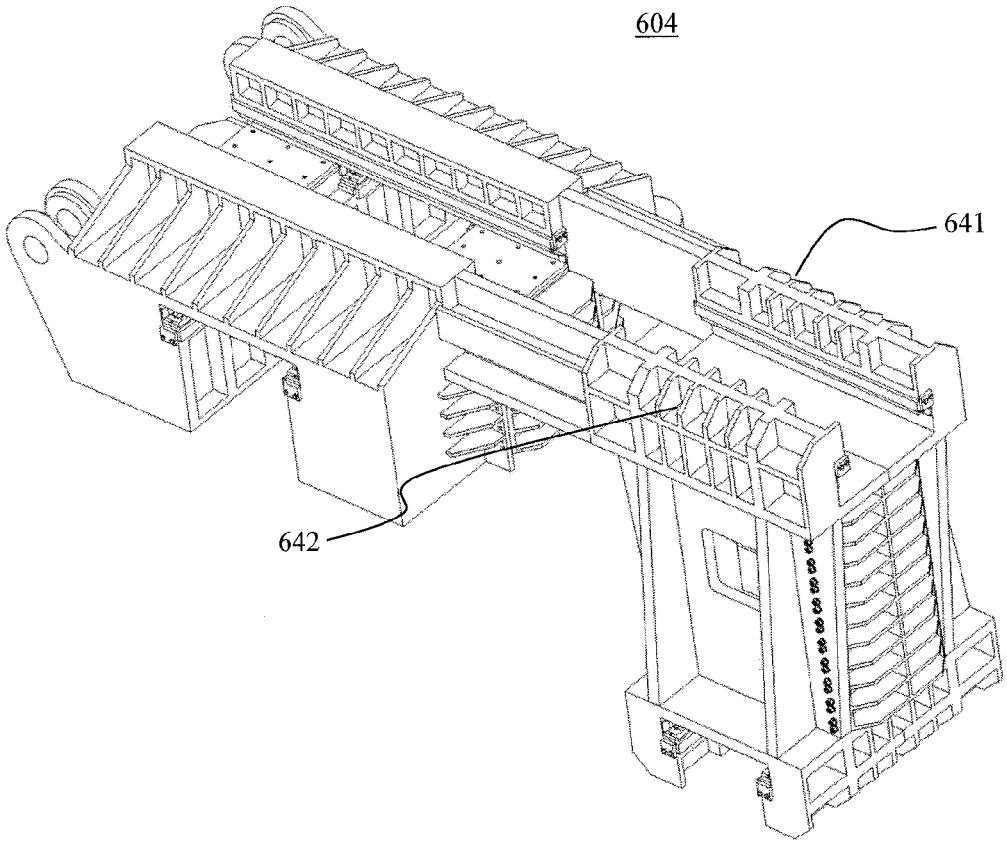
FIG. 34A is an isometric view of an alternative embodiment of forward guides in accordance with some embodiments of the present subject matter.
Figure 34B:
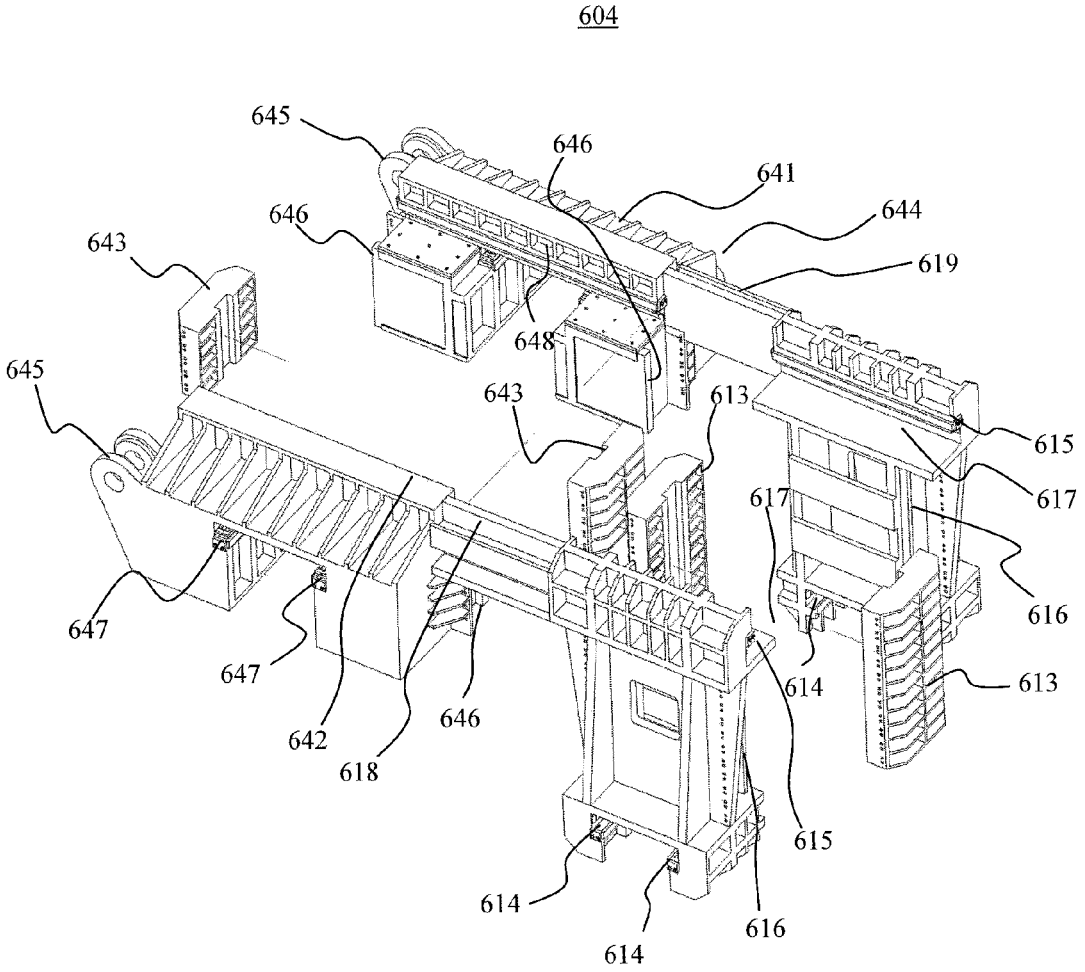
FIG. 34B is an exploded isometric view of the forward guide of FIG. 34A.
Figure 35:
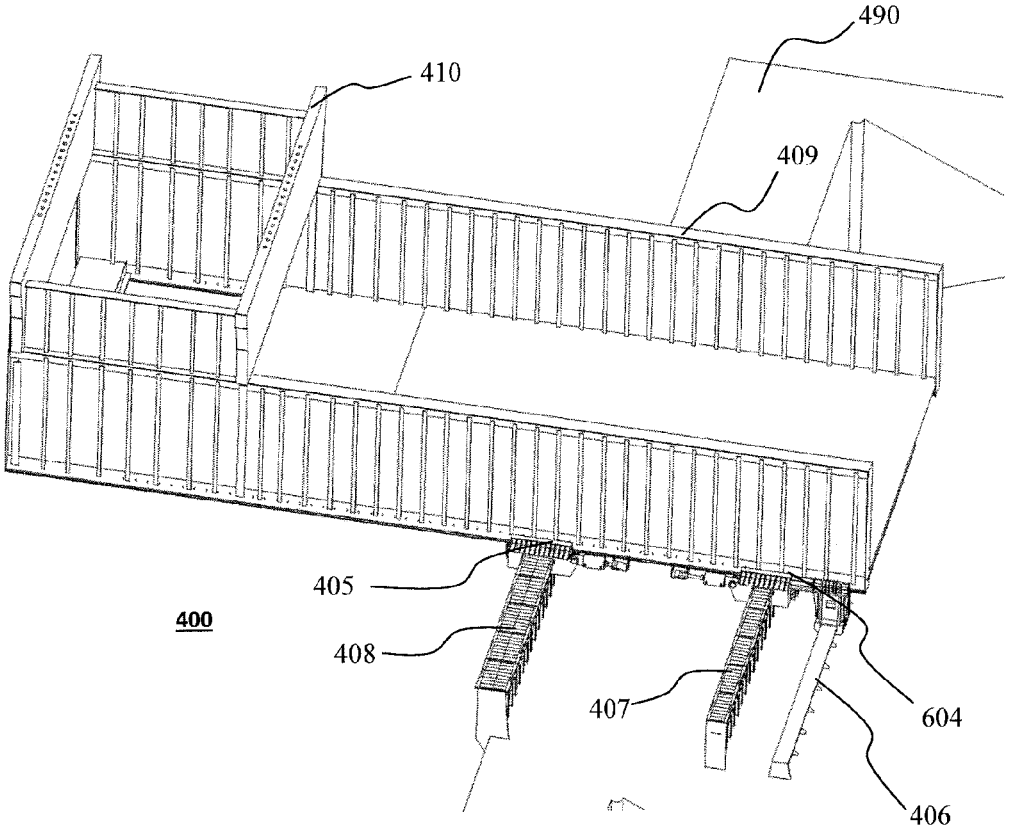
FIG. 35 is an isometric view of an exemplary drilling unit employing an exemplary three-rail multi-direction direct cantilever skidding system with the forward guide of FIGS. 34A-34B.

FIG. 34A is an isometric view of an alternative embodiment of forward guides in accordance with some embodiments of the present subject matter. FIG. 34B is an exploded isometric view of the forward guide of FIG. 34A. FIG. 35 is an isometric view of an exemplary drilling unit employing an exemplary three-rail multi-direction direct cantilever skidding system with the forward guide of FIGS. 34A-34B. With reference to FIGS. 34A, 34B and 35, an exemplary alternative forward guide 604 may include an outer fixture or portion 642 located external the cantilever 409 and an inner fixture or portion 641 located proximate and below the cantilever 409. The alternative forward guide 604 may also include a plurality of suitable locking mechanisms 643 for locking the two ends of the inner and outer fixtures 641, 642 upon assembly thereof and securing these fixtures into a rigid structure. When the inner and outer fixtures 641, 642 are assembled, the configuration may provide a slot to accommodate a proximate beam of an overlying cantilever while any cantilever loading is substantially supported by the forward transverse skidding rail 407. The inner and outer fixtures 641, 642 may be slidably disposed on the forward transverse skidding rail 407 and can be moved in a transverse direction thereon. An exemplary inner fixture 641 may include a coupling structure 644 for coupling with a transverse skid driving mechanism and a coupling structure 645 for coupling with a longitudinal skid driving mechanism. The inner fixture 641 may also include a lower slot 647 for accommodating the forward transverse skidding rail 407 and an upper slot 648 for accommodating a proximate beam of an overlying cantilever. In some embodiments, the outer fixture 642 may be substantially similar in form to the inner fixture 641. In other embodiments, the outer fixture 642 may not include coupling structures for coupling with transverse skidding mechanisms. In alternative embodiments, any one or both of the inner and outer fixtures may include coupling structures for transverse skid driving mechanisms. In the depicted non-limited embodiment, the inner and outer fixtures 641, 642 may include end flanges 646 whereby, upon assembly, suitable locking mechanisms 643 may be employed to secure or affix the outer and inner fixtures 641, 642. The exemplary alternative forward guide 604 may also include portions in each of the fixtures 641, 642 adaptable to mating with a forward hold down rail. This portion of the forward guide 604 for interfacing with the hold down rail may also include a plurality of locking mechanisms 613 for locking the two ends of the inner and outer fixtures 641, 642 upon assembly thereof and securing these fixtures into a rigid structure and may also include connecting members 618, 619 suitable connecting the portions of the guide 604 interfacing with the hold down rail to the portions of the guide 604 interfacing with the forward transverse rail. When the inner and outer fixtures 641, 642 are assembled, the configuration may provide a slot to accommodate a proximate beam of an overlying cantilever while any cantilever loading is substantially supported by the forward transverse skidding rail 407. The inner and outer fixtures 641, 642 may also be slidably disposed on the forward hold down rail 406 and may be moved in a transverse direction thereon in conjunction with transverse movement on the forward traverse rail 407. The inner fixture 641 may also include a lower slot for accommodating the forward hold down rail 407 and an upper slot for accommodating a proximate beam of an overlying cantilever. In some embodiments, the outer fixture 642 may be substantially similar in form to the inner fixture 641. The inner and outer fixtures 641, 642 may provide a claw 614 to accommodate and wrap the forward hold down rail 406. In the depicted non-limited embodiment, the inner and outer fixtures 641, 642 may include end flanges 616 whereby, upon assembly, suitable locking mechanisms 613 may be employed to secure or affix the inner and outer fixtures 641, 642 and to form suitable claws 615 to accommodate and wrap the proximate beam of an exemplary cantilever 409.

Figure 36A:
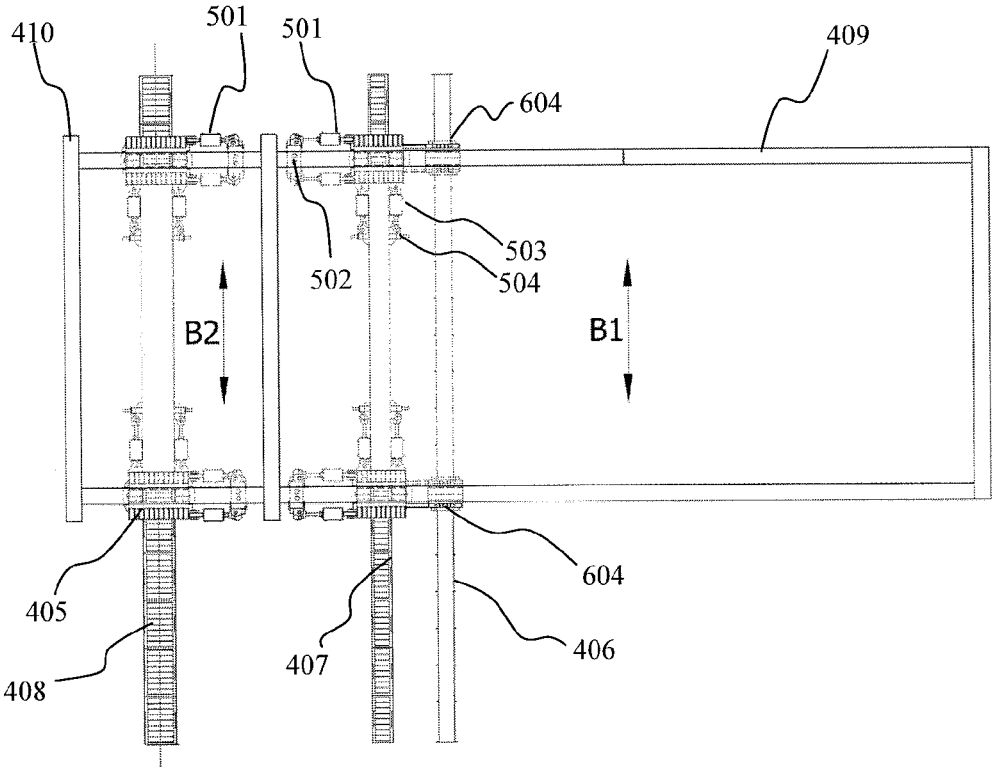
FIG. 36A is a top plan view of the drilling unit of FIG. 27 in a retracted position with the forward guide of FIGS. 34A-B.
Figure 36B:
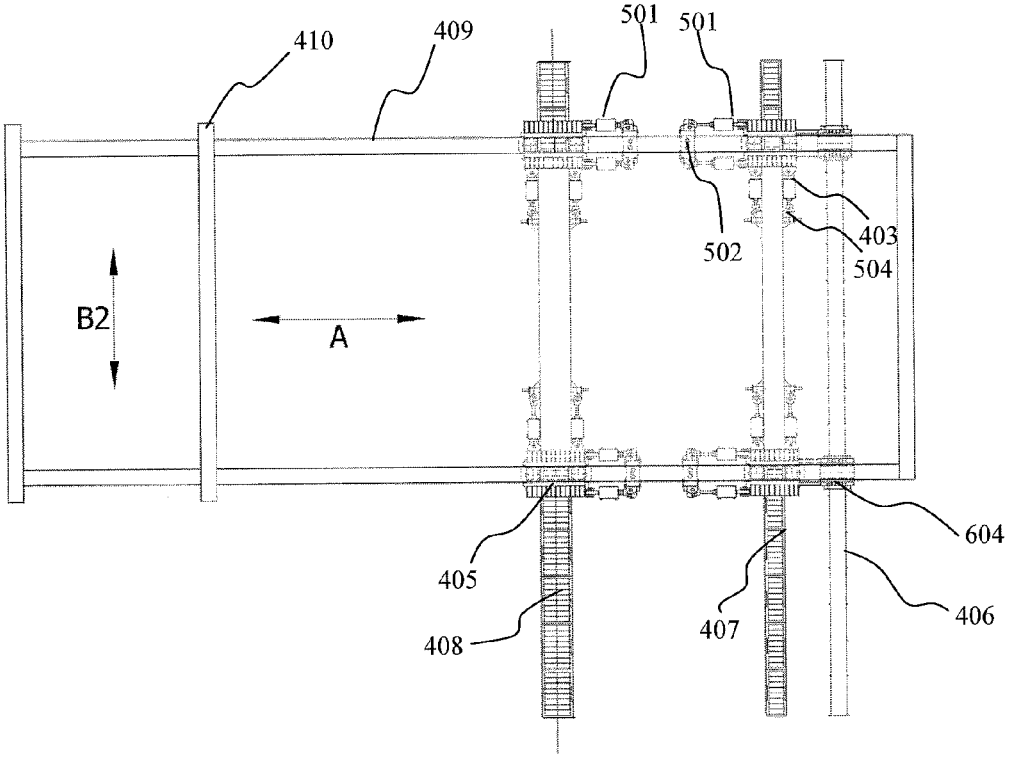
FIG. 36B is a top plan view of the drilling unit of FIG. 27 in an extended position with the forward guide of FIGS. 34A-B.
Figure 37A:
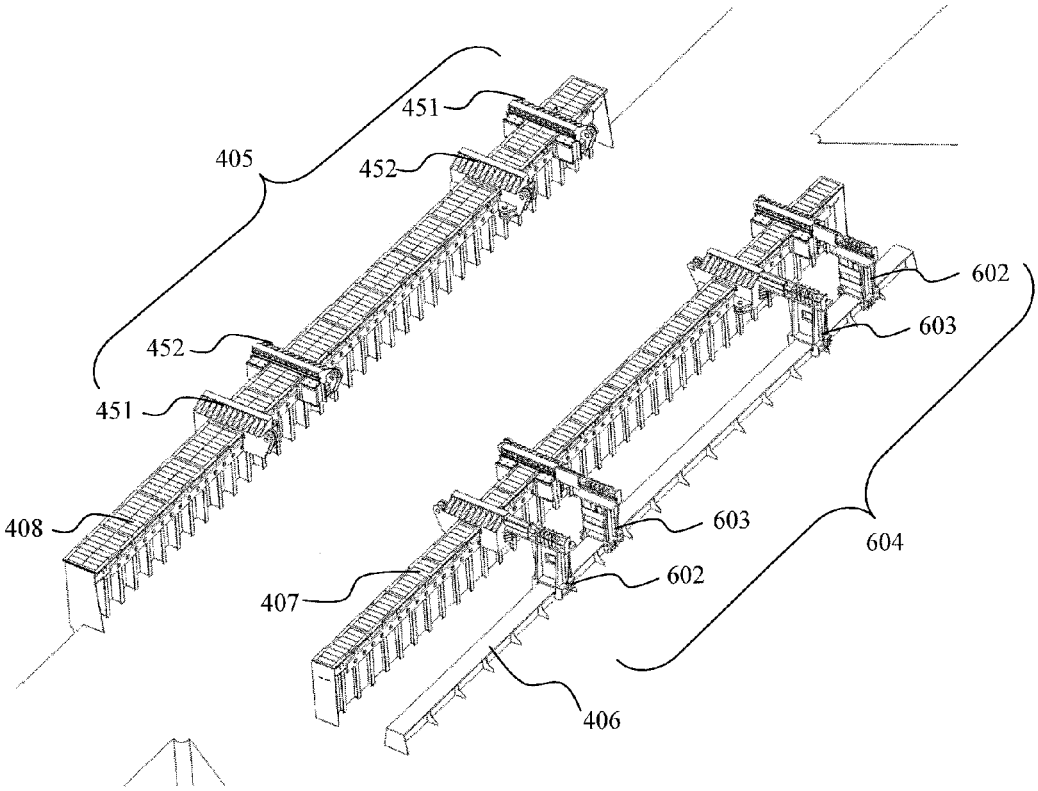
FIGS. 37A-37C are illustrations providing an exemplary sequence of installing the drilling unit of FIG. 27 having the forward guide illustrated in FIGS. 34A-34B.
Figure 37B:
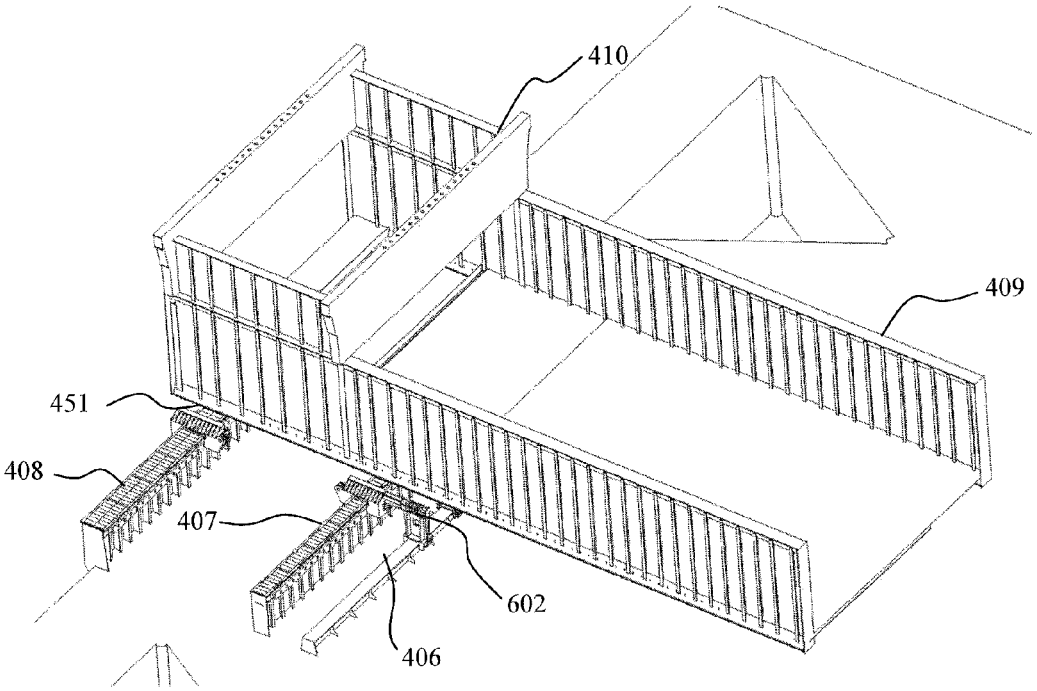
Figure 37C:
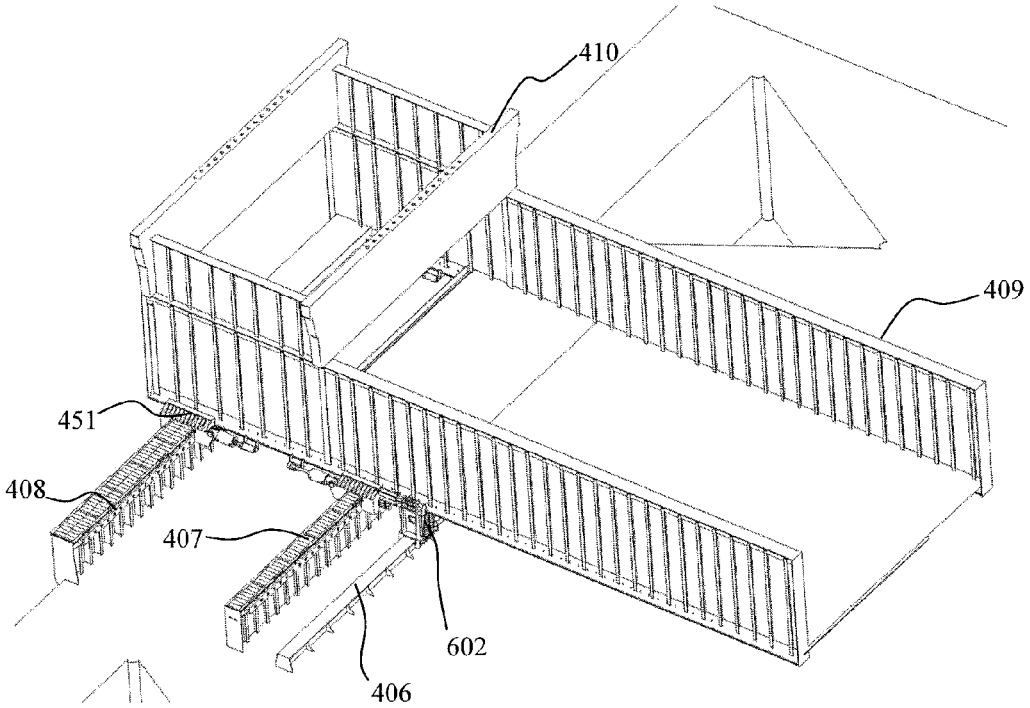

FIG. 36A is a top plan view of the drilling unit of FIG. 27 in an retracted position with the forward guide of FIGS. 34A-B. FIG. 36B is a top plan view of the drilling unit of FIG. 27 in an extended position with the forward guide of FIGS. 34A-B. With reference to FIG. 36A, transverse movement or skidding of a cantilever 409 in a transverse direction "B1" may be allowed by use of the aft skidding rail 408 and forward skidding rail 407 to provide direct loading support of the cantilever 409. In such an embodiment, the cantilever 409 is in a retracted position. It is to be appreciated that this may not be a fully retracted position, but rather a position whereby the center of gravity is moved to act between the forward and aft skidding rails. During such an operation, the forward hold down guide portion of the alternative forward guide 604 may generally be in an unloaded state. In addition to transverse movement of the cantilever 409, transverse movement of the drill floor 410 in a transverse direction "B2" may also be employed. Transverse cantilever skidding may be performed by exemplary skid driving mechanisms 503 coupled on one end with exemplary coupling structures in respective guides 405, 604 and on an opposing end with transverse skidding supports 504 to drive the cantilever 409 in a transverse direction. With reference to FIG. 36B, an exemplary cantilever 409 is illustrated in an extended position as a function of the longitudinal skidding or movement of the cantilever in direction "A" allowed by use of the aft transverse skidding rail 408 to provide support of cantilever loading and by employing the alternative forward guide 604 to provide necessary hold down forces on the forward hold down rail 406. In some embodiments, an exemplary aft skidding rail 408 may also provide support for the aft skidding guide 405 which, in turn, may provide appropriate coupling to an exemplary skid driving mechanism(s). The forward transverse skidding rail 407 may also provide loading support for the cantilever 409 when the cantilever center of gravity is retracted to a position forward of the aft skidding rail 408. In additional embodiments, the forward transverse skidding rail 407 may also provide support for the alternative forward guide 604 which, in turn, may provide appropriate coupling to an exemplary longitudinal skid driving mechanism(s). As illustrated, the cantilever 409 may not (or may) be provided with transverse movement; however, it is envisioned that transverse movement of the drill floor 410 in direction "B2" may be employed to access side wells without retracting an extended cantilever 409. Movement of the cantilever 409 in a longitudinal direction "A" may be accomplished by utilization of skid driving mechanisms 501 coupled on one end with coupling structures in exemplary cantilever skidding guides 405, 604 and on an opposing end with longitudinal skidding supports 502 to drive the cantilever 409 in a longitudinal direction FIGS. 37A-37C are illustrations providing an exemplary sequence of installing the drilling unit of FIG. 27 having the forward guide illustrated in FIGS. 34A-34B. As illustrated in FIG. 37A, aft and alternative forward guides 405, 604 may be slidably installed on the aft and forward transverse skidding rails 408, 407. The alternative forward guides 604 may also be slidably installed on the forward hold down rail 406. Any number of aft and forward guides may be utilized in embodiments of the present subject matter. In the depicted, non-limiting embodiment two aft guides 405 (comprising two halves or outer/inner fixtures 451, 452) may be disposed on the aft transverse skidding rail 408 and two alternative forward guides 604 (comprising two halves or outer/inner fixtures 602, 603) may be disposed on the forward transverse skidding rail 407 and forward hold down rail 406. In some embodiments, these guides may be installed by sliding onto the end(s) of the respective rails. In other embodiments, the guides may be assembled directly on the respective rails. As illustrated in FIG. 37B, an exemplary cantilever 409 may be installed upon the aft and forward transverse skidding rails 408, 407 and above the forward hold down rail 406. For example, the cantilever 409 may be lifted by a crane or other mechanism (not shown) to align and place the cantilever 409 on the skidding rails 407, 408 and above the forward hold down rail 406 to ensure that half of the guide and hold down claws are located on each side of the beams of the cantilever 409 and to ensure that the cantilever center of gravity is located between the rails 407, 408 thereby providing balanced support for the cantilever 409. As illustrated in FIG. 37C, the two halves of the respective guides 405, 604 may then be connected together using suitable connecting mechanisms discussed above (e.g., bolts, clamps, and the like) to create a single guide slidably wrapping around the flanges or edges of the a respective cantilever beam and skidding or hold down rail. It should be noted that the drilling unit 410 is depicted as being installed with the cantilever in FIGS. 37B and 37C; however, in other embodiments, the cantilever 409 may be installed first followed by installation of an exemplary drilling unit 410.

Thus, it is an aspect of some embodiments to provide an exemplary offshore drilling system having a Jackup platform with a Jackup deck. Transverse skidding rails may be affixed on the Jackup deck with an exemplary multi-direction direct cantilever skidding system allowing movement of a cantilever longitudinally and transversely in relation to the deck. Further, embodiments of the present subject matter allow direct support of cantilever loading on transverse skidding rails which provides for safe and effective installation and safe and effective inspection and maintenance. It should be noted that in some embodiments, as the cantilever loading or weight is supported directly on the rails when the cantilever is retracted, guide claws may be separated to allow for inspection and maintenance thereof. Another aspect of embodiments of the present subject matter provide an exemplary multi-direction direct cantilever skidding system that can be employed in a Jackup drilling unit whereby the multi-direction direct skidding system enables the cantilever to move in both longitudinal and transverse directions while allowing the transverse skidding rails to provide direct support of cantilever loading during skidding, installation and maintenance.

It is also an aspect of some embodiments of the present subject matter to provide an exemplary cantilever skidding system employable in a Jackup drilling unit of a drilling rig. During operation of an exemplary Jackup drilling unit, a cantilever can exert compression or uplift loads upon cantilever skidding rails depending upon the state of the cantilever. When the cantilever is in an extended state, the cantilever skidding forward hold down guide may thus bear large uplift loads which are transferred to the forward transverse hold down rail while the aft transverse skidding rail bears large compression loads. When the cantilever is a retracted state, the cantilever will be supported on the forward and aft transverse skidding rails. In both cases, the cantilever skidding guides will not bear a large compression load. Thus, embodiments of the present subject matter provide an exemplary cantilever skidding arrangement having a plurality of rails to bear compression and/or uplift loads so a Jackup drilling unit may be operated, installed and maintained in a safe manner.

As shown by the various configurations and embodiments illustrated in FIGS. 1-37C, a multi-direction direct cantilever skidding system has been described.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A cantilever skidding system for an offshore drilling system comprising:
- a plurality of aft guides slidably disposed on an aft transverse skidding rail;
- a plurality of forward hold down guides slidably disposed on a forward transverse skidding rail;
- a plurality of skid driving mechanisms;
- a plurality of longitudinal skidding supports slidably attached to a proximate cantilever; and
- a plurality of transverse skidding supports slidably attached on the aft and forward transverse skidding rails,
- wherein the plural aft guides and forward hold down guides accommodate the cantilever and enable the aft and forward transverse rails to support the cantilever, and
- wherein each of the plurality of the skid driving mechanisms is coupled at one end thereof to one of the plural aft guides or forward hold down guides and coupled at the other end thereof to one of the plural longitudinal or transverse skidding supports to thereby allow both longitudinal and transverse movement of the cantilever.

2. The cantilever skidding system of claim 1 wherein one or more of the plurality of forward hold down guides further comprises:
- an outer fixture having a horizontal central member coupled with two vertical members and having one or more longitudinal coupling structures thereon affixing the outer fixture to one of the plural skid driving mechanisms;
- an inner fixture having a horizontal central member coupled with two vertical members and having one or more longitudinal coupling structures thereon affixing the inner fixture to the one of the plural skid driving mechanisms and having one or more transverse coupling structures thereon affixing the inner fixture to another of the plural skid driving mechanisms; and
- locking mechanisms to lock the outer and inner fixtures together,
- wherein the locked and coupled fixtures form an engaging interface on an upper portion of the hold down guide with a proximate beam of a cantilever and form an engaging interface on a lower portion of the hold down guide with a proximate transverse skidding rail.

3. The cantilever skidding system of claim 2 wherein the locking mechanisms are selected from the group consisting of clamps, bolts, interlocking arrangements, and a combination thereof.

4. The cantilever skidding system of claim 1 wherein one or more of the plurality of forward hold down guides further comprises:
- an outer fixture having a horizontal central member coupled with two vertical members and having one or more longitudinal coupling structures thereon affixing the outer fixture to one of the plural skid driving mechanisms;
- an inner fixture having a horizontal central member coupled with two vertical members; and
- locking mechanisms to lock the outer and inner fixtures together,
- wherein the locked and coupled fixtures form an engaging interface on an upper portion of the hold down guide with a proximate beam of a cantilever and form an engaging interface on a lower portion of the hold down guide with a proximate transverse skidding rail.

5. The cantilever skidding system of claim 1 wherein the skid driving mechanisms are selected from the group consisting of hydraulic skidding cylinders, rotary skidding mechanisms, electric skidding mechanisms, and combinations thereof.

6. A drilling rig comprising:

a rig platform;

parallel aft and forward transverse skidding rails each secured on the rig platform;

a cantilever skidding system slidably disposed on the parallel transverse skidding rails, the cantilever skidding system comprising:

a plurality of aft guides slidably disposed on the aft transverse skidding rail, a plurality of forward hold down guides slidably disposed on the forward transverse skidding rail, a plurality of skid driving mechanisms, a plurality of longitudinal skidding supports slidably attached to the cantilever, and a plurality of transverse skidding supports slidably attached to the aft and forward transverse skidding rails;

a cantilever slidably disposed on the transverse skidding rails and slidably engaged by the plurality of aft guides and forward hold down guides; and a drilling floor slidably disposed on the cantilever, wherein the plural aft guides and forward hold down guides accommodate the cantilever and enable the aft and forward transverse rails to support the cantilever, and wherein each of the plurality of the skid driving mechanisms is coupled at one end thereof to one of the plural aft or forward guides and coupled at the other end thereof to one of the plural longitudinal or transverse skidding supports to thereby allow both longitudinal and transverse movement of the cantilever.

7. The drilling rig of claim 6 wherein the aft and forward transverse rails have different cross sections.

8. The drilling rig of claim 6 wherein the drilling rig is a Jackup drilling rig.

9. The drilling rig of claim 6 further comprising skidding pads disposed on the rails to reduce friction between the rails and the cantilever.

10. The drilling rig of claim 6 further comprising skidding pads disposed on the aft guides, forward hold down guides, or both to reduce friction between the rails and the cantilever.

11. The drilling rig of claim 6 wherein one or more of the plurality of forward hold down guides further comprises:

an outer fixture having a horizontal central member coupled with two vertical members and having one or more longitudinal coupling structures thereon affixing the outer fixture to one of the plural skid driving mechanisms; and an inner fixture having a horizontal central member coupled with two vertical members and having one or more longitudinal coupling structures thereon affixing the inner fixture to the one of the plural skid driving mechanisms and having one or more transverse coupling structures thereon affixing the inner fixture to another of the plural skid driving mechanisms; and locking mechanisms to lock the outer and inner fixtures together, wherein the locked and coupled fixtures form an engaging interface on an upper portion of the hold down guide with a proximate beam of the cantilever and form an engaging interface on a lower portion of the hold down guide with a proximate transverse skidding rail.

12. The drilling rig of claim 11 wherein the locking mechanisms are selected from the group consisting of clamps, bolts, interlocking arrangements, and a combination thereof.

13. The drilling rig of claim 6 wherein one or more of the plurality of forward hold down guides further comprises:

an outer fixture having a horizontal central member coupled with two vertical members; and an inner fixture having a horizontal central member coupled with two vertical members; and locking mechanisms to lock the outer and inner fixtures together, wherein the locked and coupled fixtures form an engaging interface on an upper portion of the hold down guide with a proximate beam of the cantilever and form an engaging interface on a lower portion of the hold down guide with a proximate transverse skidding rail.

14. The drilling rig of claim 6 wherein the skid driving mechanisms are selected from the group consisting of hydraulic skidding cylinders, rotary skidding mechanisms, electric skidding mechanisms, and combinations thereof.

15. The drilling rig of claim 6 wherein movement of the drilling module is independent of any movement of the cantilever.

16. An offshore drilling system comprising:

a jackup platform with a jackup deck; and a jackup drilling unit comprising:

parallel aft and forward transverse skidding rails each secured on the jackup deck;

a cantilever skidding system slidably disposed on the parallel transverse skidding rails, the cantilever skidding system comprising:

a plurality of aft guides slidably disposed on the aft transverse skidding rail, a plurality of forward hold down guides slidably disposed on the forward transverse skidding rail, a plurality of skid driving mechanisms, a plurality of longitudinal skidding supports slidably attached to the cantilever, and a plurality of transverse skidding supports slidably attached to the aft and forward transverse skidding rails;

a cantilever a cantilever slidably disposed on the transverse skidding rails and slidably engaged by the plurality of aft guides and forward hold down guides; and a drilling floor slidably disposed on the cantilever, wherein the plural aft guides and forward hold down guides accommodate the cantilever and enable the aft and forward transverse rails to support the cantilever, and wherein each of the plurality of the skid driving mechanisms is coupled at one end thereof to one of the plural aft or forward guides and coupled at the other end thereof to one of the plural longitudinal or transverse skidding supports to thereby allow both longitudinal and transverse movement of the cantilever.

17. The offshore drilling system of claim 16 wherein the aft and forward transverse rails have different cross sections.

18. The offshore drilling system of claim 16 further comprising skidding pads disposed on one or more of the rails to reduce friction between the rails and the cantilever.

19. The offshore drilling system of claim 16 further comprising skidding pads disposed on the aft guides, forward hold down guides, or both to reduce friction between the rails and the cantilever.

20. The offshore drilling system of claim 16 wherein one or more of the plurality of hold down guides further comprises:

an outer fixture having a horizontal central member coupled with two vertical members and having one or more longitudinal coupling structures thereon affixing the outer fixture to one of the plural skid driving mechanisms; and an inner fixture having a horizontal central member coupled with two vertical members and having one or more longitudinal coupling structures thereon affixing the inner fixture to the one of the plural skid driving mechanisms and having one or more transverse coupling structures thereon affixing the inner fixture to another of the plural skid driving mechanisms; and locking mechanisms to lock the outer and inner fixtures together, wherein the locked and coupled fixtures form an engaging interface on an upper portion of the hold down guide with a proximate beam of the cantilever and form an engaging interface on a lower portion of the hold down guide with a proximate transverse skidding rail.

21. The offshore drilling system of claim 20 wherein the locking mechanisms are selected from the group consisting of clamps, bolts, interlocking arrangements, and a combination thereof.

22. The offshore drilling system of claim 16 wherein one or more of the plurality of hold down guides further comprises:

an outer fixture having a horizontal central member coupled with two vertical members;

an inner fixture having a horizontal central member coupled with two vertical members; and locking mechanisms to lock the outer and inner fixtures together, wherein the locked and coupled fixtures form an engaging interface on an upper portion of the hold down guide with a proximate beam of the cantilever and form an engaging interface on a lower portion of the hold down guide with a proximate transverse skidding rail.

23. The offshore drilling system of claim 16 wherein the skid driving mechanisms are selected from the group consisting of hydraulic skidding cylinders, rotary skidding mechanisms, electric skidding mechanisms, and combinations thereof.

24. The offshore drilling system of claim 16 wherein movement of the drilling module is independent of any movement of the cantilever.

* * * * *